US007913658B2

(12) United States Patent
Yamamoto et al.

(10) Patent No.: US 7,913,658 B2
(45) Date of Patent: Mar. 29, 2011

(54) VALVE ACTUATING MECHANISM FOR AN INTERNAL COMBUSTION ENGINE, AND CYLINDER HEAD INCORPORATING SAME

(75) Inventors: Toshio Yamamoto, Saitama (JP); Masahiro Shimizu, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 430 days.

(21) Appl. No.: 12/079,740

(22) Filed: Mar. 27, 2008

(65) Prior Publication Data

US 2008/0236526 A1 Oct. 2, 2008

(30) Foreign Application Priority Data

Mar. 30, 2007 (JP) ..... 2007-095090

(51) Int. Cl.
*F01L 1/34* (2006.01)

(52) U.S. Cl. ..... 123/90.16; 123/90.15; 123/90.39

(58) Field of Classification Search ..... 123/90.16, 123/90.39, 90.15
See application file for complete search history.

(56) References Cited

U.S. PATENT DOCUMENTS

| | | | |
|---|---|---|---|
| 3,878,822 | A | 4/1975 | Beal |
| 4,253,434 | A | 3/1981 | Takizawa et al. |
| 4,354,460 | A | 10/1982 | Mae et al. |
| 4,534,323 | A | 8/1985 | Kato et al. |
| 5,203,289 | A | 4/1993 | Hara et al. |

FOREIGN PATENT DOCUMENTS

| | | | |
|---|---|---|---|
| DE | 33 16446 | A1 | 11/1983 |
| DE | 33 46 556 | A1 | 7/1984 |
| DE | 33 15396 | A1 | 10/1984 |
| DE | 195 44 242 | A1 | 6/1996 |
| JP | 60-85205 | | 5/1985 |
| JP | 2001-020710 | | 1/2001 |

*Primary Examiner* — Zelalem Eshete
(74) *Attorney, Agent, or Firm* — Carrier Blackman & Associates, P.C.; Joseph P. Carrier; William D. Blackman

(57) ABSTRACT

A valve actuating mechanism for an internal combustion engine includes a first rocker arm moving mechanism, a second rocker arm moving mechanism, and a trigger arm. The first rocker arm moving mechanism moves left and right rocker arms from a first operation position side to a second operation position side. The second rocker arm moving mechanism moves the left and right rocker arms from the second operation position side to the first operation position side, and the trigger arm selectively restricts the movement of the left and right rocker arms. During engine operation, left and right rocker-side key portions of the left and right rocker arms, respectively, and left and right trigger-side key portions of the trigger arm selectively maintain or remove a restriction on the movement of the left and right rocker arms, in response to a rocking state of the left and right rocker arms.

19 Claims, 22 Drawing Sheets

FIG. 6A
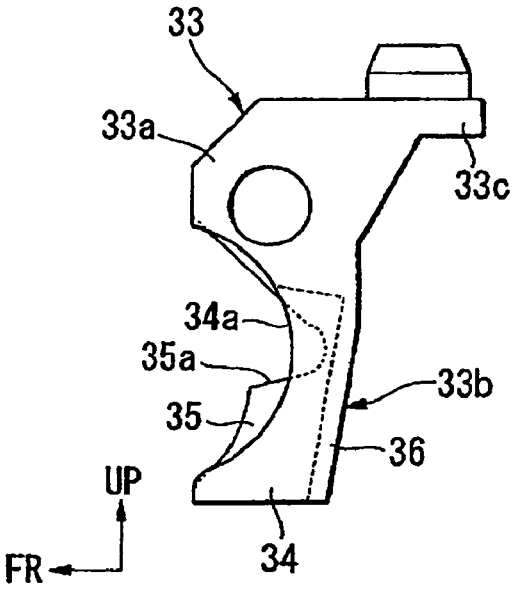
FIG. 6B
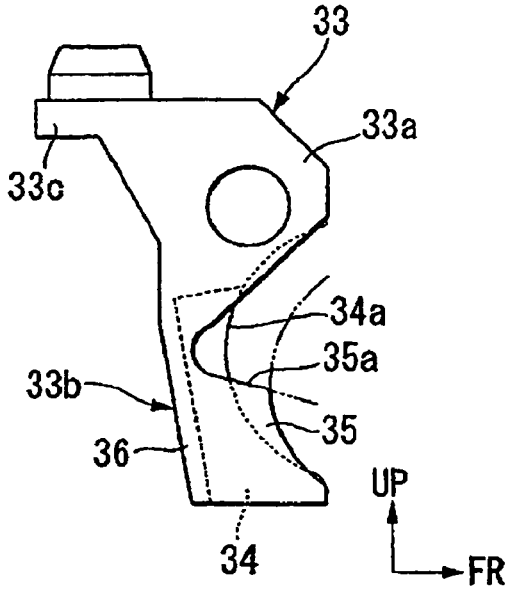
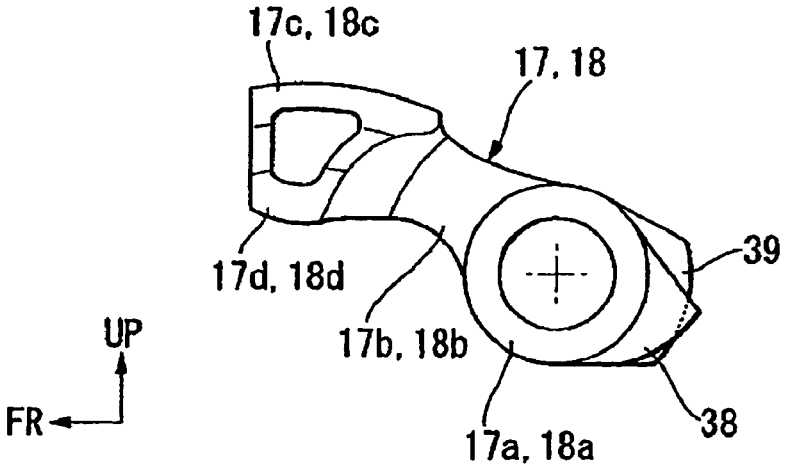
FIG. 7

VALVE ACTUATING MECHANISM FOR AN INTERNAL COMBUSTION ENGINE, AND CYLINDER HEAD INCORPORATING SAME

CROSS REFERENCE TO RELATED APPLICATIONS

This application claims the benefit under 35 USC 119 of Japanese Application No. 2007-095090 filed Mar. 30, 2007, and the entire subject matter of this priority document, including specification, claims and drawings is incorporated by reference.

BACKGROUND OF THE INVENTION

1. Field of the Invention

The present invention relates to a variable valve actuating mechanism for a four-stroke internal combustion engine, preferably applicable to a vehicle such as a motorcycle, in which the variable valve actuating mechanism includes a camshaft having a pair of cams for one engine valve, and can selectively use either one of the respective cams for performing an opening/closing operation of the engine valve, depending on engine operating conditions.

2. Description of the Background Art

Conventionally, it has been known to provide a valve actuating mechanism which includes a camshaft, a rocker arm shaft arranged in parallel with the camshaft, and a rocker arm supported on the rocker arm shaft such that the rocker arm is pivotally movable about an axis of the rocker arm shaft, and is also slidably axially movable of the rocker arm shaft. In response to the rotary motion of the camshaft, the rocker arm is brought into contact with either one of the respective cams, and is pivotally rocked to open or close the engine valve. At the same time, the rocker arm is suitably moved in the axial direction thus allowing the selective use of either one of the respective cams for performing opening/closing operation of the engine valve, as disclosed in Japanese published patent application JP-A-2001-20710. In this reference, although the rocker arm is moved in the axial direction using an engine oil pressure depending on an open/closed state of the engine valve, the camshaft pushes the engine valve downwardly by way of the rocker arm (valve open state) and hence, there arises a drawback that it is necessary to increase a force applied to move the rocker arm. Further, when an electric sensor, an electric control or the like is used for moving the rocker arm corresponding to an open/closed state of the engine valve, the arrangement of the valve actuating mechanism per se becomes complicated.

BRIEF SUMMARY OF THE INVENTION

Accordingly, it is an object of the present invention to provide an engine valve actuating mechanism which can change a cam, for opening or closing an engine valve, by moving a rocker arm in the axial direction of a rocking shaft, wherein the valve actuating mechanism can move the rocker arm corresponding to an open/closed state of the engine valve with a relatively simple arrangement.

To overcome the above-mentioned drawbacks, an engine valve actuating mechanism according to a first illustrative embodiment hereof includes a camshaft that includes a pair of first and second cams for one engine valve, and a rocker arm which is supported on a rocker arm shaft arranged in parallel with the camshaft, such that the rocker arm is pivotally movable about an axis of the rocker arm shaft and is selectively axially movable of the rocker arm shaft, wherein the rocker arm is brought into contact with either one of the respective cams in response to the rotary driving of the camshaft, and is pivotally rocked to open or close the engine valve. The rocker arm is moved to either one of a first operation position, at which the rocker arm is brought into contact with the first cam in the axial direction, and a second operation position at which the rocker arm is brought into contact with the second cam in the axial direction, thus allowing the valve actuating mechanism to selectively use either one of the respective cams for performing actuation of the valve.

The improvement is characterized in that the valve actuating mechanism further includes a first rocker arm moving mechanism which moves the rocker arm from the first operation position side to the second operation position side, a second rocker arm moving mechanism which moves the rocker arm from the second operation position side to the first operation position side, and a trigger member which is supported on an engine structural body for restricting the movement of the rocker arm in the axial direction of the rocker arm in response to a rocking state of the rocker arm. The rocker arm and the trigger member respectively include a rocker-side key portion and a trigger-side key portion which are capable of being brought into contact with each other in the axial direction, and the respective key portions are configured to increase or decrease contact margins thereof in the axial direction in response to a rocking state of the rocker arm and eliminate the contact margin thereof when the engine valve is closed, and the rocker arm is moved to the corresponding operation position by either one of the respective rocker arm moving mechanisms.

The rocker-side key portion comprises a pair of first and second rocker-side key portions, and the trigger-side key portion comprises a pair of first and second trigger-side key portions corresponding to the respective rocker-side key portions, and one of the pairs of corresponding key portions of the respective rocker-side key portions and the respective trigger-side key portions eliminates the contact margin in the axial direction at the time of predetermined rocking of the rocker arm. The rocker arm is moved by a predetermined quantity to the corresponding operation position side due to either one of the respective rocker arm moving mechanism in response to the elimination of the contact margin. The respective key portions of one pair overlap by a predetermined quantity in the axial direction, wherein by continuously rocking the rocker arm in this state, the respective key portions of one pair operate the trigger portions so as to eliminate a contact margin of the respective key portions of another pair in the axial direction. Thus, the rocker arms are movable to the corresponding operation position.

The engine valve and the respective cams are provided in a pair for each one cylinder, and the rocker arm comprises a pair of first and second rocker arms which respectively correspond to the pair of engine valves and the respective cams and are pivotally movable relative to each other, and the first and second rocker-side key portions are respectively mounted on the first and second rocker arms.

Between the corresponding key portions of the respective rocker-side key portions and the respective trigger-side key portions, a predetermined gap is formed in the axial direction such that forces from the respective rocker arm moving mechanism are not communicated to the portions.

The trigger member is rockably supported on the engine structural body. Between the trigger member and the engine structural body is provided a resilient member which biases the trigger member toward a side at which the contact margin of the respective key portions in the axial direction is increased and, at the same time, a rocking restriction portion which restricts the rocking angle of the trigger member while also suppressing the deformation of the resilient member is provided.

By mechanically providing the restriction on the movement of the rocker arm and the removal of the restriction in response to the rocking state of the rocker arm, that is, in response to an open/closed state of the engine valve, it is possible to move the rocker arm. Particularly, the restriction on the movement of the rocker arm is removed when the engine valve is closed and hence, the force, which is imparted for moving the rocker arm, can be reduced. Further, an electric sensor, a control and the like for detecting the open/closed state of the engine valve become unnecessary and hence, it is possible to simplify the valve actuating mechanism per se. Here, the above-mentioned one engine valve may include a plurality of engine valves which corresponds to one cylinder and is operated simultaneously.

The pair of key portions mounted on the rocker arm and the pair of key portions mounted on the trigger member are respectively brought into contact with each other in the axial direction, and the restriction on the movement of the rocker arm brought about by the contact of the respective key portions is removed by the pair of respective key portions which overlap each other in the axial direction by a predetermined overlapping quantity and hence, no additional parts other than the rocker arm and the trigger member are necessary as parts for removing the restriction on the movement of the rocker arm attributed to the trigger member thus reducing the number of parts.

The opening/closing timings or the lift quantities of the respective engine valve can be set individually and, at the same time, the restrictions on the movement of the respective rocker arms can be removed individually in response to the rocking state of the respective rocker arms.

At the time of performing a usual operation of the engine to which forces are not imparted from the respective rocker arm moving mechanism, frictions generated between the respective key portions can be reduced and, at the same time, when the restriction on the movement of the rocker arms are removed, it is possible to ensure the moving quantity at the time of overlapping the respective key portions of one pair with a predetermined quantity in the axial direction.

In eliminating the contact margin of the respective key portions in the axial direction at the time of removing the restriction on the movement of the rocker arm, it is possible to reduce a load applied to the resilient member by reducing an excessive rocking angle of the trigger member thus contributing to the miniaturization, the reduction of weight and the reduction of cost of the resilient member.

BRIEF DESCRIPTION OF THE DRAWINGS

FIG. 6(*a*) is a left side view of a trigger arm which is a component of the variable valve adjustment mechanism, and FIG. 6(*b*) is a right side view of the trigger arm.

FIG. 7 is a left side view of left and right rocker arms of the variable valve adjustment mechanism, as viewed in an overlapped manner.

DETAILED DESCRIPTION OF ILLUSTRATIVE EMBODIMENTS

Figure 1:
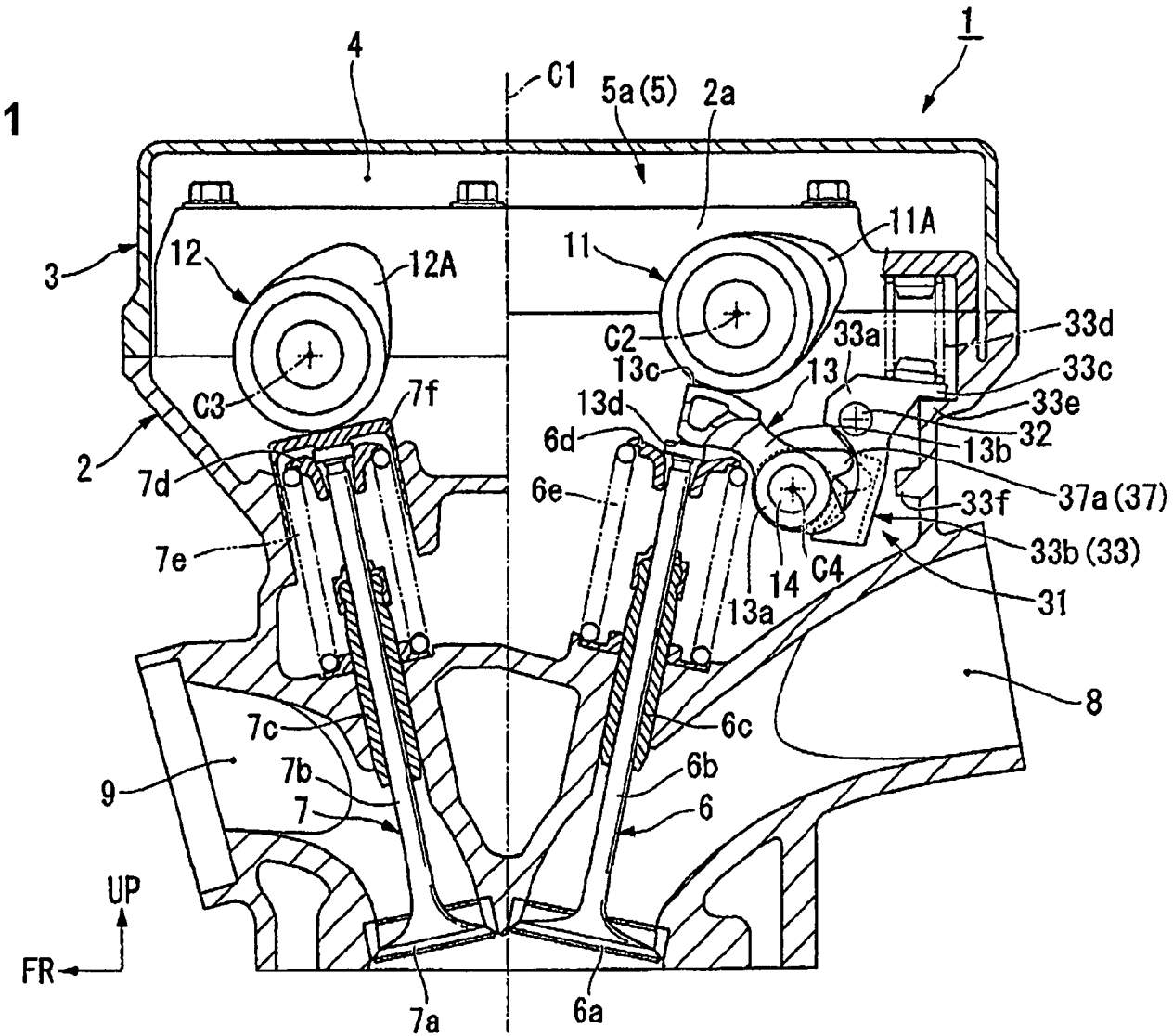
FIG. 1 is a left side view, partially in cross-section, of a cylinder head of an engine according to an illustrative embodiment of the present invention.

Hereinafter, an embodiment of the present invention is explained in conjunction with the drawings. Here, in the explanation made hereinafter, an arrow FR indicates the front direction, an arrow LH indicates the leftward direction, and an arrow UP indicates the upward direction in the drawings respectively.

FIG. 1 is a left side view of a cylinder head 2 of a 4-stroke DOHC parallel 4-cylinder engine 1, which is used as a prime mover of a vehicle such as a motorcycle, for example. A head cover 3 is mounted on an upper portion of the cylinder head 2. A valve chamber 4 is formed between the cylinder head 2 and the head cover 3, and a valve actuation system 5 for driving intake and exhaust valves 6, 7 is housed inside of the valve chamber 4. Here, the symbol C1 in the drawing indicates a center axis (cylinder axis) of a cylinder bore of a cylinder body.

Intake and exhaust ports 8, 9 are formed in the cylinder head 2 for each cylinder, and combustion-chamber openings of the intake and exhaust ports 8, 9 are respectively opened and closed by the intake and exhaust valves 6, 7. The respective intake and exhaust valves 6, 7 are configured such that rod-like stems 6*b*, 7*b* thereof extend from umbrella-shaped valve elements 6*a*, 7*a* which are fitted in the combustion chamber openings, with machined faces thereof oriented toward the valve chamber 4 side. The valve stems 6*b*, 7*b* are held in place in the cylinder head 2 by way of cylindrical valve guides 6*c*, 7*c*, which allow the valves to move therein in a slidable reciprocating manner.

Retainers 6*d*, 7*d* are mounted on distal end portions of the stems 6*b*, 7*b* of the respective valves 6, 7. The respective valves 6, 7 are biased upwardly due to a biasing force of valve springs 6*e*, 7*e* which are arranged between the retainers 6*d*, 7*d* and the cylinder head 2, and the valve elements 6*a*, 7*a* close the combustion chamber-side openings.

On the other hand, the valve elements 6*a*, 7*a* of the respective valves 6, 7 are periodically moved away from the combustion chamber-side openings to open the combustion chamber-side openings by allowing the respective valves 6, 7 to perform a stroke downwardly against the biasing force of the valve springs 6*e*, 7*e* when the respective associated camshafts 11, 12 cause such downward movement of the valves.

The respective valves 6, 7 are arranged in the cylinder head 2 such that the stems 6*b*, 7*b* thereof are inclined in a V-shaped manner with respect to a cylinder axis C1, as viewed in a side view. An intake-side camshaft 11 and an exhaust-side camshaft 12 which extend along the lateral direction are respectively arranged above the respective stems 6*b*, 7*b*. The respective camshafts 11, 12 are supported on the cylinder head 2 (including a shaft holder 2*a*) in a manner so as to be rotatable about the respective axes thereof.

When the engine 1 is driven, for example, the camshafts 11, 12 are rotated in an interlocking manner with a crankshaft, by way of a chain-type power transmission mechanism (neither the power transmission mechanism nor the crankshaft are shown in the drawing). Here, in the drawing, symbols C2, C3 indicate center axes (cam axes) of the respective camshafts 11, 12. In the depicted embodiment, the engine 1 is of a 4-valve type, and includes a pair of left and right intake and exhaust valves 6, 7 for every cylinder thereof.

The respective intake valves 6 are opened and closed by being pushed by a cam 11A of the intake-side camshaft 11 by way of a respective rocker arm 13 provided for each cylinder. The rocker arm 13 is supported on a rocker arm shaft 14, which is arranged in parallel to the intake-side camshaft 11 behind a distal end portion of the stem 6*b* of the intake valve 6 in a pivotally movable manner about an axis of the rocker arm shaft 14.

On the other hand, the respective exhaust valves 7 are opened and closed by being pushed directly by a cam 12A of the exhaust-side camshaft 12, by way of a valve lifter 7*f*, which is mounted on a distal end portion of the stem 7*b*. Here, symbol C4 in the drawing indicates a center axis (rocker axis) of the rocker arm shaft 14.

An arm portion 13*b* of the rocker arm 13 extends from a cylindrical proximal portion 13*a*, to contact a distal end portion of the stem 6*b* of the intake valve 6. The cylindrical proximal portion 13*a* is affixed to the rocker arm shaft 14 of the rocker arm 13. The cam 11A of the intake-side camshaft 11 is in a slidable contact with a cam slide-contact portion 13*c* of the rocker arm 13, and this slide-contact portion 13*c* is mounted on an upper portion of the distal end portion of the arm portion 13*b*. At the same time, a valve pushing portion 13*d* of the rocker arm 13, which can push the distal end portion of the stem 6*b* downwardly, is mounted on a lower portion of the distal end portion of the arm portion 13*b*, opposite the cam slide-contact portion 13*c*.

Further, when the intake-side camshaft 11 is rotatably driven during operation of the engine 1, the cam 11A of the camshaft 11 is brought into sliding contact with the cam slide-contact portion 13*c*, thus suitably rocking the rocker arm 13. Accordingly, the valve pushing portion 13*d* of the rocker arm 13 pushes the distal end portion of the stem 6*b* of the intake valve 6 downwardly, so that the intake valve 6 is suitably reciprocated along the stem 6*b* to open or close the combustion-chamber-side opening. Here, the rocker arm 13 may include a cam roller (not shown), which is brought into rolling contact with the cam 11A of the intake-side camshaft 11.

Further according to the depicted embodiment, the valve actuation system 5 includes a variable valve adjustment mechanism 5*a*, which changes valve opening/closing timings and lift quantities of the respective intake valves 6. For example, in a low-rotary speed range in which an engine rotary speed is less than 6000 rpm (revolution per minute), the variable valve adjustment mechanism 5*a* opens and closes the respective intake valves 6 using a low-speed cam lobe of the intake-side camshaft 11. Alternatively, in a high-speed rotation range in which the engine rotary speed is 6000 rpm or more, the variable valve adjustment mechanism 5*a* opens and closes the respective intake valves 6 using a high-speed cam lobe of the intake-side camshaft 11.

Hereinafter, the variable valve adjustment mechanism 5*a* corresponding to one cylinder is explained. In the explanation made hereinafter, however, assuming that other cylinders also have the substantially same variable valve adjustment mechanism as in the one described cylinder, repeated explanation is omitted.

Figure 2:
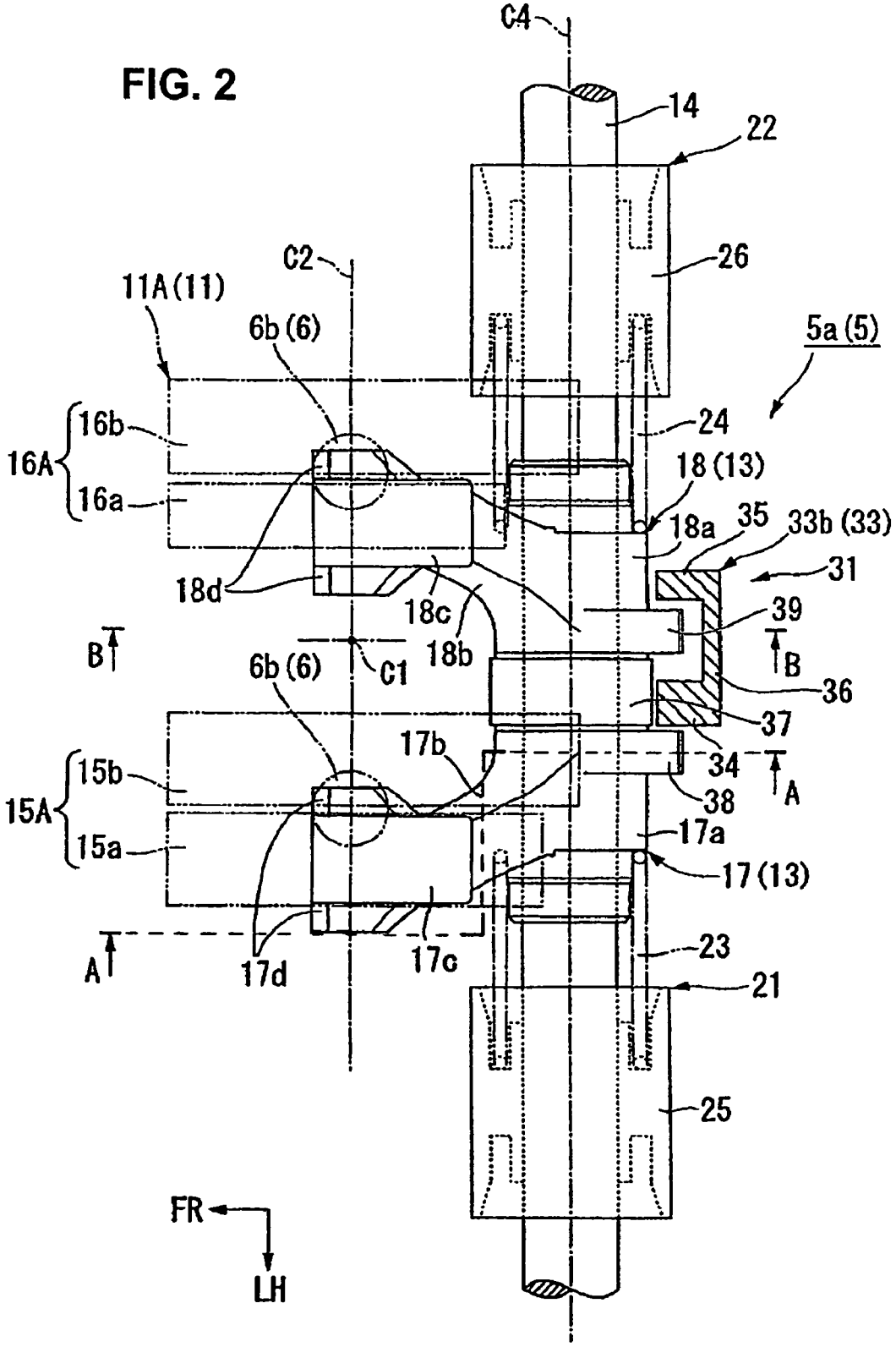
FIG. 2 is a top plan detail view of an essential part of a variable valve adjustment mechanism of the engine at a time of low-speed operation thereof.

To explain the variable valve adjustment mechanism 5*a* also in conjunction with FIG. 2, the cam 11A of the intake-side camshaft 11 comprises the left and right first cams 15*a*, 16*a* for low-speed rotation range, and the left and right second cams 15*b*, 16*b* for high-speed rotation range, which correspond to the left and right intake valves 6. That is, the intake-side camshaft 11 includes four cams in total consisting of the left and right first cams 15*a*, 16*a* and the left and right second cams 15*b*, 16*b*, which respectively correspond to the left and right intake valves 6 for one cylinder.

Hereinafter, a pair of the first cams and a pair of second cams which respectively correspond to the left and right intake valves 6 are grouped to as left and right cam pairs 15A, 16A, where the first cam pair 15A includes a first set of low and high-speed cams 15*a*, 15*b* and the second cam pair 16A includes the second set of low and high-speed cams 16*a*, 16*b*. The left and right cam pairs 15A, 16A are arranged at positions in substantially left-and-right symmetry with respect to the cylinder axis C1, which is sandwiched between the pairs. The left and right cam pairs 15A, 16A are spaced apart from each other, with a predetermined distance therebetween in the cam axis direction. Further, the left and right cam pairs 15A, 16A respectively arrange the first cams 15*a*, 16*a* close to each other in the cam axis direction, and also arrange the second cams 15*b*, 16*b* close to each other in the cam axis direction, such that the first cams 15*a*, 16*a* are arranged on a left side and the second cams 15*b*, 16*b* are arranged on a right side, respectively.

Further, the rocker arm 13 is supported on the rocker arm shaft 14 so as to be pivotally movable about an axis (about a rocker axis C4) of the rocker arm shaft 14, and the rocker arm is also movable sideways in the axial direction (in the direction along the rocker axis C4) of the rocker arm shaft 14. Further, the rocker arm 13 is divided into left and right rocker arms 17, 18 which are independently movable relative to each other (pivotally movable relative to each other about the axis and movable relative to each other in the axial direction).

The left and right rocker arms 17, 18 are respectively provided corresponding to the left and right intake valves 6. In addition, the left and right rocker arms 17, 18 are separately and individually rocked by the left and right first (low-speed) cams 15*a*, 16*a* or by the second (high-speed) cams 15*b*, 16*b*, thus opening and closing the left and right intake valves 6.

Hereinafter, proximal portions of the left and right rocker arms 17, 18 near the shaft 14 are respectively indicated by numerals 17*a*, 18*a*, while outwardly-extending arm portions of the left and right rocker arms 17, 18, are respectively indicated by numerals 17*b*, 18*b*, and these arm portions are spaced away from the shaft 14. Cam slide-contact portions of the left and right rocker arms 17, 18 are respectively indicated by numerals 17*c*, 18*c*, while valve-pushing portions of the left and right rocker arms 17, 18 are respectively indicated by numerals 17*d*, 18*d*. Here, as seen in FIG. 2, the left and right arm portions 17*b*, 18*b*, the cam slide-contact portions 17*c*, 18*c*, and the valve pushing portions 17*d*, 18*d* are respectively offset in lateral outward directions of the cylinder, relative to the left and right proximal portions 17*a*, 18*a*.

Figure 4B:
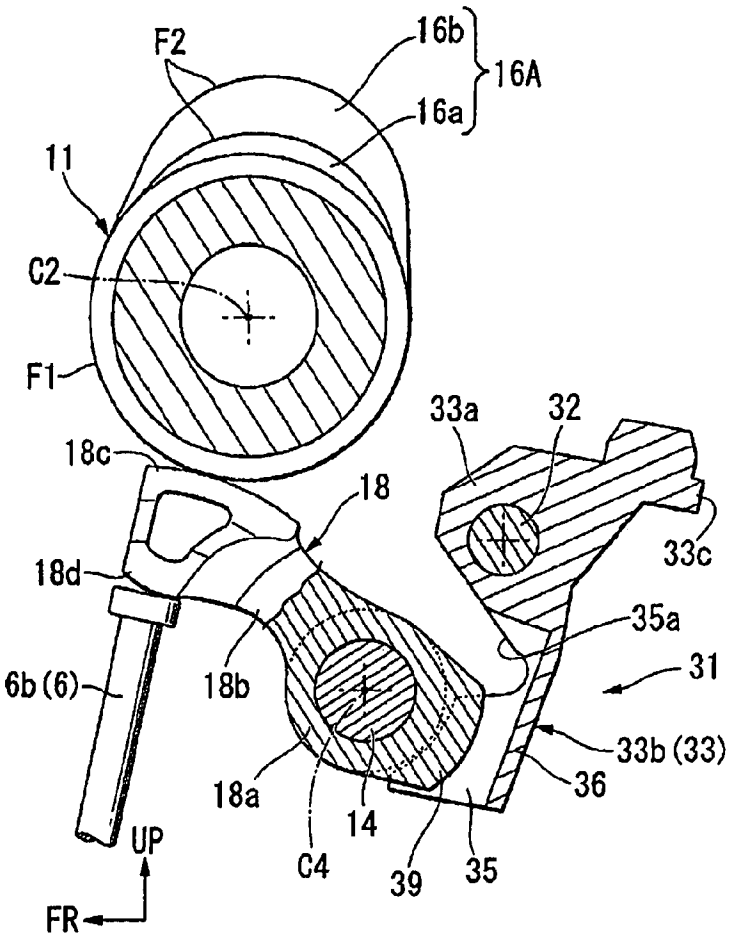
FIG. 4(*a*) is a cross-sectional view taken along a line A-A in FIG. 2, and FIG. 4(*b*) is a cross-sectional view taken along a line B-B in FIG. 2.
Figure 4A:
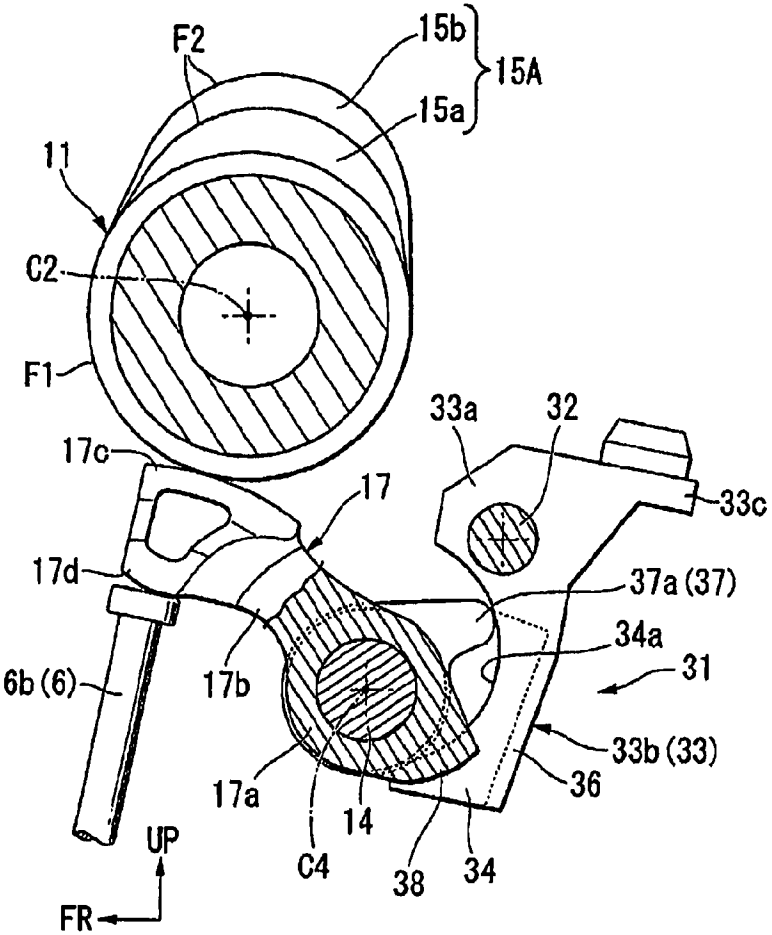

To explain the above-mentioned arrangement also in conjunction with FIG. 4, the first cams 15*a*, 16*a* and the second cams 15*b*, 16*b* include both evenly spaced zero-lift surfaces F1 extending part way therearound, and hill-shaped lift surfaces (cam lobes) F2, which project radially outwardly from the level of the zero-lift surfaces F1, at predetermined rotary positions of the cams. The zero-lift surfaces F1 use the cam axis C2 as the center thereof, and have the same diameter throughout. When the zero-lift surfaces F1 of the respective cams 15*a*, 16*a*, 15*b*, 16*b* face the cam slide-contact portions 17*c*, 18*c* of the left and right rocker arms 17, 18 in an opposed manner, the intake valves 6 remain completely closed (a lift quantity assumes 0).

In contrast, when the lift surfaces (cam lobes) F2 are brought into sliding contact with the cam slide-contact portions 17*c*, 18*c* of the rocker arms 13, the intake valves 6 are opened a predetermined amount (the intake valves 6 being moved a predetermined distance).

Projection quantities (lift quantities) of the lift surfaces F2 of the first, low-speed cams 15*a*, 16*a* are set smaller than projection quantities (lift quantities) of the second, high-speed cams 15*b*, 16*b*. Further, projection quantities and shapes of the lift surfaces F2 of the second cams 15*b*, 16*b* of the left and right cam pairs 15A, 16A are set equal to each other. On the other hand, the projection quantity of the lift surface F2 of the first cam 16*a* out of the right cam pair 16A is set smaller than the projection quantity of the lift surface F2 of the first cam 15*a* out of the left cam pair 15A, for example.

Accordingly, an intake-air speed in the low-speed rotation range of the engine 1 is increased and, at the same time, the difference in intake-air quantity at the time of changing over the cams is increased. Accordingly, it is possible to emphasize the change of the intake-air characteristic. Here, the lift quantity of the first cam 16*a* of the right cam pair 16A may be set to zero, if desired, or the projection quantities of the lift surfaces F2 of the first cams 15*a*, 16*a* may be set equal to each other.

Under certain conditions to be described later herein, first and second rocker arm moving mechanisms 21, 22 (described later) slidably move the left and/or right rocker arms 17, 18 axially inwardly in a lateral direction of the cylinder. The rocker arms 17, 18 are integrally movably supported on the rocker arm shaft 14, and are individually axially movable on the rocker arm shaft 14 such that the proximal portions 17*a*, 18*a* of the left and right rocker arms 17, 18 move in an axial direction of the rocker arm shaft 14. The proximal portions 17*a*, 18*a* may be moved inwardly until they contact side edges of an enlarged center collar 37 formed integrally on the rocker arm shaft.

When the operation of the engine 1 is stopped, or when the engine 1 is operated in a low-speed rotation range, the left and right rocker arms 17, 18 assume leftward-movement limit positions in the axial direction. In such a state, the cam slide-contact portions 17*c*, 18*c* thereof are arranged at positions below the first cams 15*a*, 16*a* of the respective left and right cam pairs 15A, 16A where the slide-contact portions 17*c*, 18*c* can be brought into slide contact with outer peripheral surfaces (cam surfaces) of the first cams 15*a*, 16*a*.

The valve pushing portions 17*d*, 18*d* of the left and right rocker arms 17, 18 are formed with lateral widths thereof set wider than lateral widths of the cam slide-contact portions 17*c*, 18*c*. When the left and right rocker arms 17, 18 assume the above-mentioned leftward-movement limit positions, right end portions of the left and right rocker arms 17, 18 are arranged at positions where they can push the distal end portions of the stems 6*b* of the left and right intake valves 6, respectively. Here, the positions of the left and right rocker arms 17, 18 in the axial orientation shown in FIG. 2, close to the left and right first (low-speed) cams 15*a*, 16*a*, are referred to as first operation positions.

Figure 3:
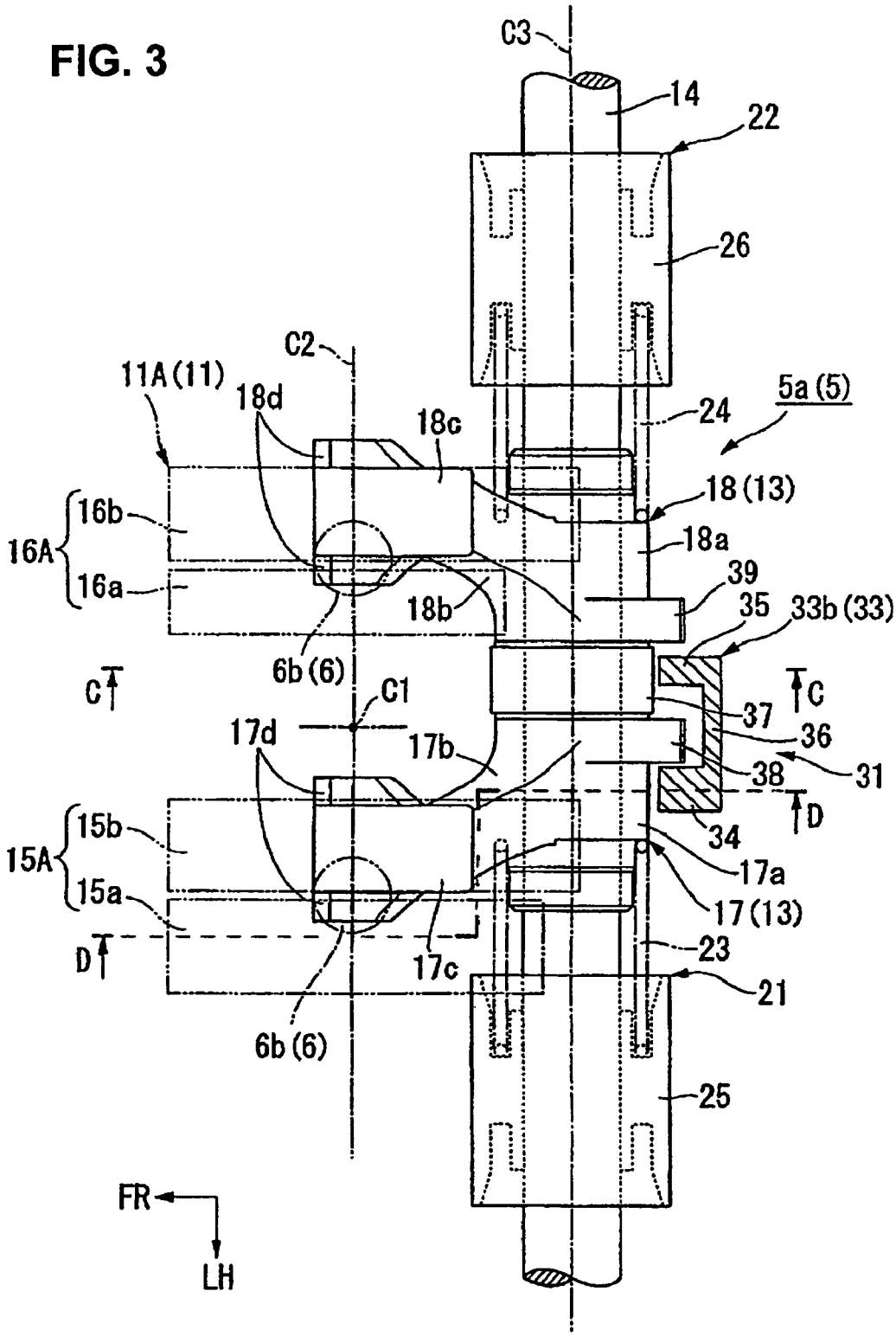
FIG. 3 is a top plan detail view of the essential part of the variable valve adjustment mechanism at a time of high-speed operation thereof.

On the other hand, to explain the above-mentioned arrangement also in conjunction with FIG. 3, the left and right rocker arms 17, 18 move into the axial rightward-movement limit positions in the axial direction when the engine 1 is operated in a high-speed rotation range. In such a state, the cam slide-contact portions 17*c*, 18*c* of the left and right rocker arms 17, 18 are respectively arranged at positions below the second cams 15*b*, 16*b* of the left and right cam pairs 15A, 16A where the cam slide-contact portions 17*c*, 18*c* can be brought into slide contact with the outer peripheral surfaces (cam surfaces) of the second cams 15*b*, 16*b*.

When the left and right rocker arms 17, 18 assume the above-mentioned rightward-movement limit positions, left end portions of the valve pushing portions 17*d*, 18*d* of the left and right rocker arms 17, 18 are arranged at positions where the left end portions can push the distal end portions of the stems 6*b* of the left and right intake valves 6. Here, positions of the left and right rocker arms 17, 18 in the axial direction shown in FIG. 3, close to the left and right second (high-speed) cams 15*a*, 16*a*, are referred to as second operation positions.

That is, in response to the engine rotary speed, the variable valve adjustment mechanism 5*a* operates the first and second rocker arm moving mechanisms 21, 22 to axially move the left and right rocker arms 17, 18 on the rocker arm shaft 14 to either the first operation position or the second operation position. Accordingly, the variable valve adjustment mechanism 5*a* allows for the selective use of either the first, low-speed cam set 15*a*, 16*a*, or the second, high-speed cam set 15*b*, 16*b* in the operation of the left and right intake valves 6.

Operation of the first and second rocker arm moving mechanisms 21, 22 will now be described. The first rocker arm moving mechanism 21 includes a first spring 23, which is positioned on a left side of the proximal portion 17*a* of the left rocker arm 17. The first spring 23 applies a biasing force to the proximal portion 17*a* directed towards the second (high-speed) operation position side. The first rocker arm moving mechanism 21 also includes a first spring-receiving collar 25, which is positioned on a left side of the first spring 23 and is affixed to an outer periphery of the rocker arm shaft 14, in a manner such that the first spring-receiving collar 25 is not axially movable relative to the rocker arm shaft 14.

In a similar manner, the second rocker arm moving mechanism 22 includes a second spring 24, which is positioned on a right side of the proximal portion 18*a* of the right rocker arm 18, and which applies a biasing force to the proximal portion 18*a* directed towards the first (low speed) operation position side. The second rocker arm moving mechanism 22 also includes a second spring-receiving collar 26, which is positioned on a right side of the second spring 24, and which is affixed to the outer periphery of the rocker arm shaft 14, in a manner such that the second spring-receiving collar 26 is not axially movable relative to the rocker arm shaft 14.

Each of the respective springs 23, 24 is formed as a compression coil spring, which is arranged to wrap around the outer periphery of the rocker arm shaft 14 (to allow the rocker arm shaft 14 to penetrate the springs 23, 24). A right end portion of the first spring 23 is fitted in a left-side outer periphery of the proximal portion 17*a* of the left rocker arm 17, and a left end portion of the first spring 23 is fitted in a right-side inner periphery of the first spring-receiving collar 25. On the other hand, a left end portion of the second spring 24 is fitted in a right-side outer periphery of the proximal portion 18*a* of the right rocker arm 18, and a right end portion of the second spring 24 is fitted in a left-side inner periphery of the second spring-receiving collar 26.

Here, the rocker arm shaft 14 is supported on the cylinder head 2 such that the rocker arm shaft 14 is axially movable thereof and is also pivotally movable about an axis thereof.

When the operation of the engine 1 is stopped, or when the engine 1 is operated in a low-speed range, the rocker arm shaft 14 and the respective spring-receiving collars 25, 26 assume the leftward-movement limit position in the axial direction thereof (see FIG. 2). Here, the left and right rocker arms 17, 18 assume the first operation position, and the respective springs 23, 24 are arranged between the proximal portions 17*a*, 18*a* of the left and right rocker arms 17, 18 and the spring-receiving collars 25, 26 in a compressed manner, such that a predetermined initial compression is applied to the springs 23, 24. Here, initial loads which the respective springs 23, 24 possess are set equal to each other and hence, the left and right rocker arms 17, 18 can be held at the first operation position, as shown.

On the other hand, to explain the above-mentioned arrangement in conjunction with FIG. 3, when the engine 1 is operated in a high-speed range, the rocker arm shaft 14 and the respective spring-receiving collars 25, 26 assume the rightward-movement limit position in the axial direction thereof. Here, the left and right rocker arms 17, 18 assume the second operation position, and the respective springs 23, 24 are arranged between the proximal portions 17*a*, 18*a* of the left and right rocker arms 17, 18 and the respective spring-receiving collars 25, 26 in a contracted or compressed manner, such that an initial compression is applied to the springs 23, 24 in the substantially same manner as described above. Here, initial loads which the respective springs 23, 24 possess are set equal to each other and hence, the left and right rocker arms 17, 18 can be held at the second operation position.

Here, the movement quantities of the rocker arm shaft 14 and the respective spring-receiving collars 25, 26 in the axial direction are equal to the movement quantities of the left and right rocker arms 17, 18 in the axial direction (a movement quantity between the respective operation positions).

Further, by integrally moving the rocker arm shaft 14 and the respective spring-receiving collars 25, 26 in the axial direction with respect to the cylinder head 2, a predetermined difference is generated in resilient force between the respective springs 23, 24, such that the movements of the left and right rocker arms 17, 18 in the axial direction with respect to the cylinder head 2 are restricted by a rocker arm movement-restricting mechanism 31 (described later).

To be more specific, when the rocker arm shaft 14 and the respective spring-receiving collars 25, 26 are moved from the leftward-movement limit position to the rightward-movement limit position with respect to the cylinder head 2, the first spring 23 is compressed by a quantity corresponding to the movement of the rocker arm shaft 14 and the respective spring-receiving collars 25, 26, thus increasing the resilient force of the first spring 23. At the same time, the second spring 24 is expanded by the quantity corresponding to the movement of the rocker arm shaft 14 and the respective spring-receiving collars 25, 26, thus decreasing the resilient force of the second spring 24.

On the other hand, when the rocker arm shaft 14 and the respective spring-receiving collars 25, 26 are moved from the rightward-movement limit position to the leftward-movement limit position with respect to the cylinder head 2, the second spring 24 is compressed by a quantity corresponding to the movement of the rocker arm shaft 14 and the respective spring-receiving collars 25, 26 thus increasing the resilient force of the second spring 24 and, at the same time, the first spring 23 is expanded by a quantity corresponding to the movement of the rocker arm shaft 14 and the respective spring-receiving collars 25, 26 thus decreasing the resilient force of the first spring 23.

In this manner, by making use of the difference in resilient force between the respective springs (hereinafter, referred to as the resilient force stored in either one of the respective springs 23, 24), the left and right rocker arms 17, 18 are moved from one operation position to the other operation position. Here, the initial compression quantities of the respective springs 23, 24 are used as the expanding quantities of the respective springs 23, 24.

The rocker arm movement-restricting mechanism 31 is provided for restricting movement of the left and right rocker arms 17, 18 in the axial direction until a predetermined resilient force is stored in either one of the respective springs 23, 24. The rocker arm movement-restricting mechanism 31 includes a trigger arm 33, which is supported on the cylinder head 2 by way of a support shaft 32 arranged parallel to the rocker arm shaft 14. The trigger arm 33 is pivotally movable about an axis of the support shaft 32, but is not axially movable on the support shaft 32.

By way of contrast, the center collar 37 is fixedly attached to the rocker arm shaft 14 between the proximal portions 17*a*, 18*a* of the left and right rocker arms 17, 18, such that the center collar 37 is not relatively rotatable about the axis of the rocker arm shaft 14, and is relatively axially movable of the rocker arm shaft 14.

The trigger arm 33 is arranged behind the rocker arm shaft 14, and the trigger arm 33 is arranged in left and right symmetry with respect to the cylinder axis C1, for example. The support shaft 32 of the trigger arm 33 is arranged at an oblique rear upper position with respect to the rocker arm shaft 14, and an arm portion 33*b* having a U-shape in cross section which includes left and right wall portions 34, 35 and a rear wall portion 36 extends downwardly from a proximal portion 33*a* of the trigger arm 33 which receives the support shaft 32 through a bore formed therein.

To explain the above-mentioned arrangement also in conjunction with FIG. 6, left and right notched portions 34*a*, 35*a* which open toward a front side while having shapes different from each other as viewed in a side view are formed in the left and right wall portions 34, 35 of the arm portion 33*b* of the trigger arm 33. To be more specific, the left notched portion 34*a* is formed in a semicircular shape, which spans between a lower side of the proximal portion 33*a* and a distal end side of the arm portion 33*b* as viewed in a side view.

On the other hand, the right notched portion 35*a* is configured such that a lower portion thereof is formed in a semicircular shape having a diameter smaller than the left notched portion 34*a*, as viewed in a side view, and an upper portion thereof is formed in a mountain shape which projects rearwardly from the left notched portion 34*a* as viewed in a side view. The lower portion and the upper portion of the right notched portion 35*a* overlap each other by a predetermined quantity in the vertical direction. Hereinafter, the left and right wall portions 34, 35 of the trigger arm 33 are respectively referred to as left and right trigger-side key portions 34, 35.

On a rear side of the proximal portion 33*a* of the trigger arm 33, a substantially horizontal plate-shaped stopper portion 33*c* is formed, which extends rearwardly. To explain the above-mentioned arrangement in conjunction with FIG. 1, the stopper portion 33*c* receives a resilient force of a spring (compression coil spring) 33*d* which is arranged between the cylinder head 2 and the stopper 33*c* in a compressed manner from above and, at the same time, brings a lower surface thereof into contact with an upper surface of a stopper receiving portion 33*e* of the cylinder head 2 and as a result, the pivotal movement (rocking) of the trigger arm 33 in the clockwise direction (CW) as seen in FIG. 1, FIG. 4 and other drawings is restricted.

Here, the trigger arm 33 is biased in the clockwise direction in FIG. 1, FIG. 4 and other drawings due to the spring 33*d*, and the trigger arm 33 is held such that the arm portion 33*b* is arranged close to the rocker arm shaft 14 from behind the rocker arm shaft 14. This state of the trigger arm 33 is referred to as a pre-rocking state of the trigger arm 33.

The rocking restriction portion 33*e* of the cylinder head 2 is formed on a portion of an inner wall surface of the cylinder head, and is arranged behind the arm portion 33*b* of the trigger arm 33. The rocking restriction portion 33*e* can be brought into contact with a rear surface of the trigger arm 33 when the trigger arm 33 is rotated in the counter-clockwise direction (CCW) in FIG. 1, FIG. 4 and other drawings. Due to such an arrangement, a rocking angle of the trigger arm 33 when the trigger arm 33 is rocked against the biasing force of the spring 33*d* can be restricted. Here, the rocking restriction portion may be situated behind a rear surface of the trigger arm 33.

As shown in FIG. 2, FIG. 4 and FIG. 7, left and right rocker-side key portions 38, 39 are formed on rear sides of the proximal portions 17*a*, 18*a* of the left and right rocker arms 17, 18. These left and right rocker-side key portions 38, 39 project rearwardly while having shapes different from each other as viewed in a side view. To be more specific, the left rocker-side key portion 38 is formed on a rear side of the right end portion of the left proximal portion 17*a* in a mountain shape as viewed in a side view. Further, the left rocker-side key portion 38 is formed in a wall-shape orthogonal to the lateral direction, and a lower portion of the left rocker-side key portion 38 is formed into an arcuate shape, which is brought into contact with a tangential line extending toward a lower end of the proximal portion 17*a* as viewed in a side view.

On the other hand, the right rocker-side key portion 39 is formed on a rear side of a left end portion of the right proximal portion 18*a* in a substantially trapezoidal shape as viewed in a side view. Further, the right rocker-side key portion 39 is formed in a wall-shape orthogonal to the lateral direction, and a rear portion of the right rocker-side key portion 39 is formed into an arcuate shape substantially coaxial with the rocker arm shaft 14 as viewed in a side view.

When the left and right rocker arms 17, 18 are arranged at the first operation position, the left-rocker-side key portion 38 is arranged adjacent to a left side of the left trigger-side key portion 34 of the trigger arm 33 (see FIG. 2), while when the left and right rocker arms 17, 18 are arranged at the second operation position, the left rocker-side key portion 38 is arranged adjacent to a right side of the left trigger-side key portion 34 (see FIG. 3). When the trigger arm 33 is in the pre-rocking state, the left trigger-side key portion 34 of the trigger arm 33 overlaps the left rocker-side key portion 38 by a predetermined quantity, as viewed in the axial direction.

On the other hand, when the left and right rocker arms 17, 18 are arranged at the first operation position, the right rocker-side key portion 39 is arranged adjacent to a left side of the right trigger-side key portion 35 of the trigger arm 33 (see FIG. 2). In contrast, when the left and right rocker arms 17, 18 are arranged at the second operation position, the right rocker-side key portion 39 is arranged adjacent to a right side of the right trigger-side key portion 35 (see FIG. 3). When the trigger arm 33 is in the pre-rocking state, the right trigger-side key portion 35 of the trigger arm 33 overlaps the right rocker-side key portion 39 by a predetermined quantity as viewed in the axial direction.

A predetermined clearance is defined in the axial direction between the left and right rocker-side key portions 38, 39 and the left and right trigger-side key portions 34, 35 which are respectively arranged adjacent to each other, such that the forces from the respective rocker arm moving mechanisms 21, 22 are not applied to the left and right rocker arms 17, 18 (a state that a predetermined initial compression is applied to the respective springs 23, 24, in other words, a state that the forces which are applied to the left and right rocker arms 17, 18 from the respective springs 23, 24 are equal to each other) (see FIG. 2, FIG. 3).

Figure 8A:
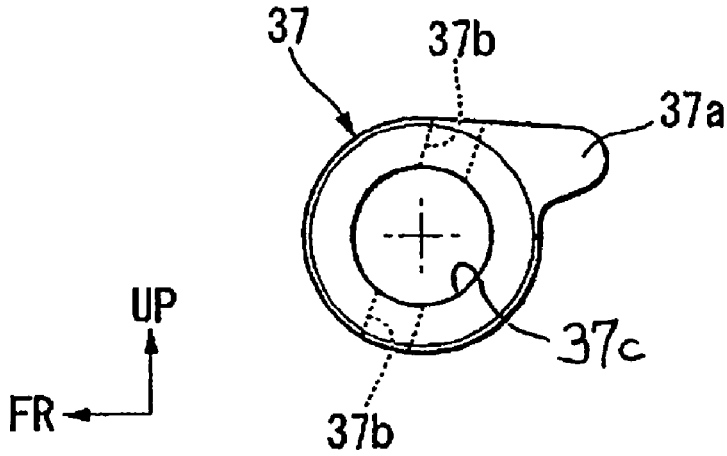
FIG. 8(*a*) is a left side view of a center collar of the variable valve adjustment mechanism, and FIG. 8(*b*) is an exploded perspective view showing the center collar being assembled to the rocker arm shaft.
Figure 8B:
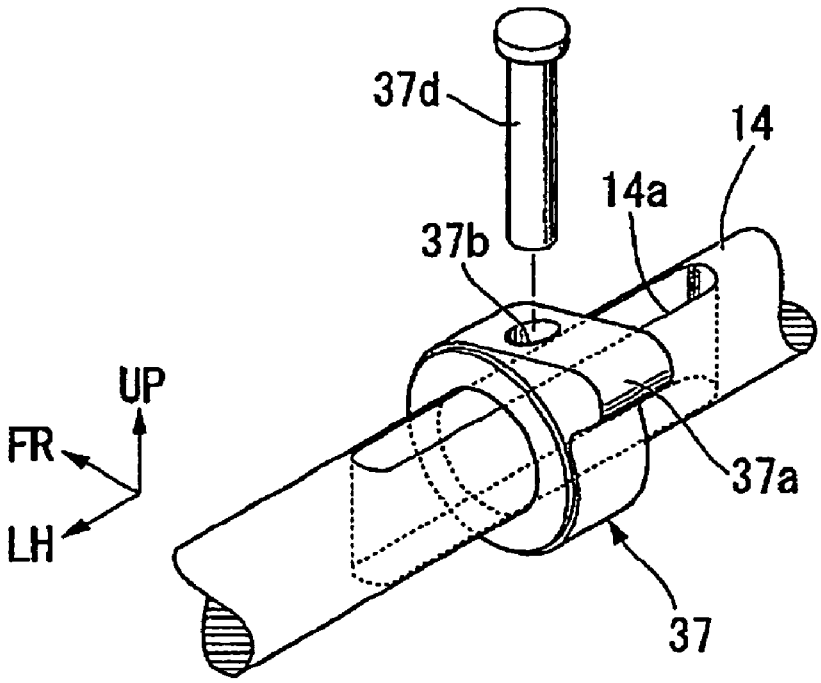

As shown in FIGS. 8A-8B, the center collar 37 is formed substantially in a ring shape, having a diameter substantially equal to diameters of the proximal portions 17*a*, 18*a* of the left and right rocker arms 17, 18. The center collar 37 has a central bore 37*c* formed axially therethrough to slidably receive the rocker arm shaft 14 therein. The center collar 37 also includes a center cam portion 37*a*, formed on a rear outer side of an upper portion of the center collar 37. The center cam portion 37*a* extends rearwardly along a substantially horizontal tangential line. The center collar 37 also has a radial through hole 37*b* formed therein, which extends radially outwardly from the central bore 37*c* through the center collar 37 in opposite directions, as shown in FIG. 8A.

In addition, a central slot 14*a* is formed in the rocker arm shaft 14 at a predetermined position, and this central slot 14*a* extends through the rocker arm shaft 14 in the radial direction while extending a predetermined length in the axial direction, as shown.

The center collar 37 is mounted on the rocker arm shaft 14 at the predetermined position, and these parts are assembled to each other by way of an engaging pin 37*d* which penetrates the through hole 37*b* and the central slot 14*a*. Accordingly, the center collar 37 is supported on the rocker arm shaft 14 at the predetermined position such that the center collar 37 is not relatively rotatable about the axis of the rocker arm shaft 14, but is relatively axially movable on the rocker arm shaft 14 by a quantity corresponding to the length of the central slot 14*a*.

Figure 5B:
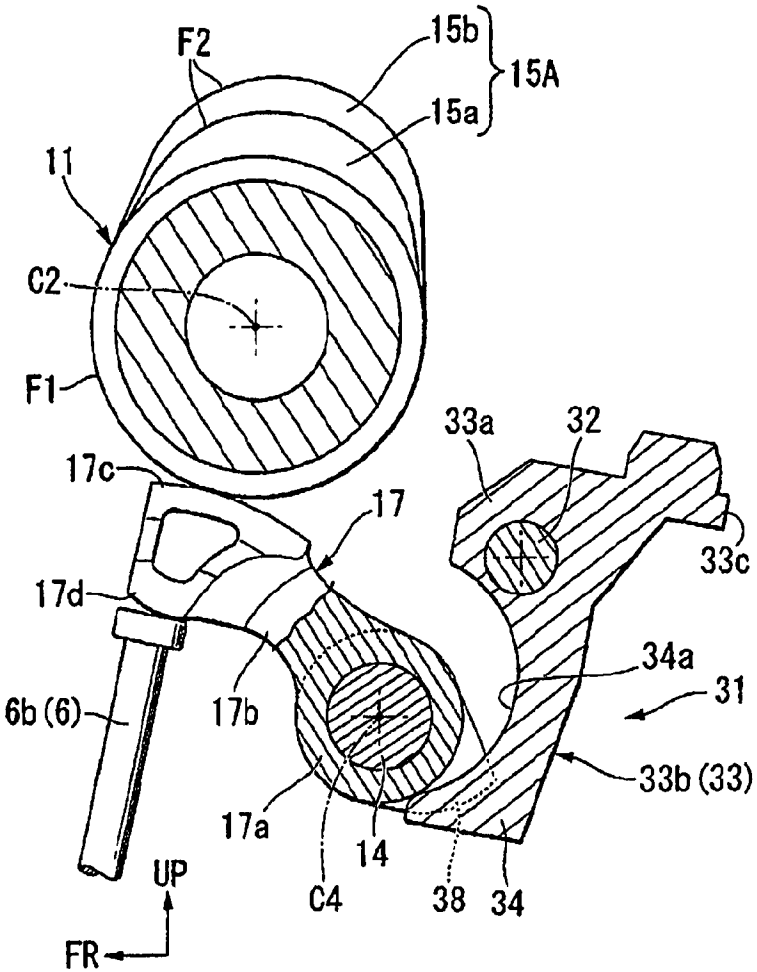
FIG. 5(*a*) is a cross-sectional view taken along a line C-C in FIG. 3, and FIG. 5(*b*) is a cross-sectional view taken along a line D-D in FIG. 3.
Figure 5A:
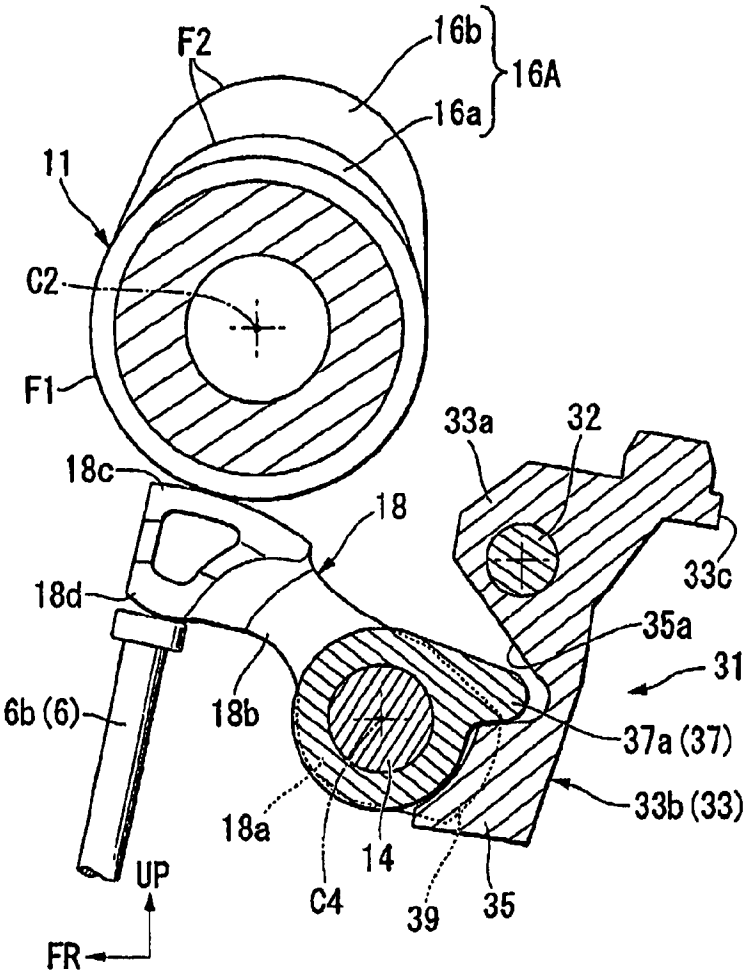

To explain the above-mentioned arrangement in conjunction with FIG. 2 and FIG. 4(*a*), when the left and right rocker arms 17, 18 are arranged at the first operation position, the center cam portion 37*a* is arranged inside of the notched portion 34*a* of the left trigger-side key portion 34 of the trigger arm 33, and a distal end portion of the center cam portion 37*a* is arranged close to an upper inner peripheral surface of the left notched portion 34*a*. On the other hand, to explain the above-mentioned arrangement in conjunction with FIG. 3 and FIG. 5, when the left and right rocker arms 17, 18 are arranged at the second operation position, the center cam portion 37*a* is arranged in the inside of the notched portion 35*a* of the right trigger-side key portion 35 of the trigger arm 33, and a distal end portion of the center cam portion 37*a* is arranged close to an upper inner peripheral surface of the right notched portion 35*a*.

Here, the rocker arm shaft 14 is moved in the axial direction thereof with respect to the cylinder head 2 due to an operation of a shaft driving mechanism 41 described later, and at the same time, the rocker arm shaft 14 is also rotatable about the axis thereof. To be more specific, when the rocker arm shaft 14 is arranged at the leftward-movement limit position, the rocker arm shaft 14 is arranged at a counterclockwise rotation limit position about an axis thereof in FIG. 4 and other drawings, and when the rocker arm shaft 14 is arranged at the rightward-movement limit position, the rocker arm shaft 14 is arranged at a clockwise rotation limit position about the axis thereof in FIG. 4 and other drawings.

Figure 10B:
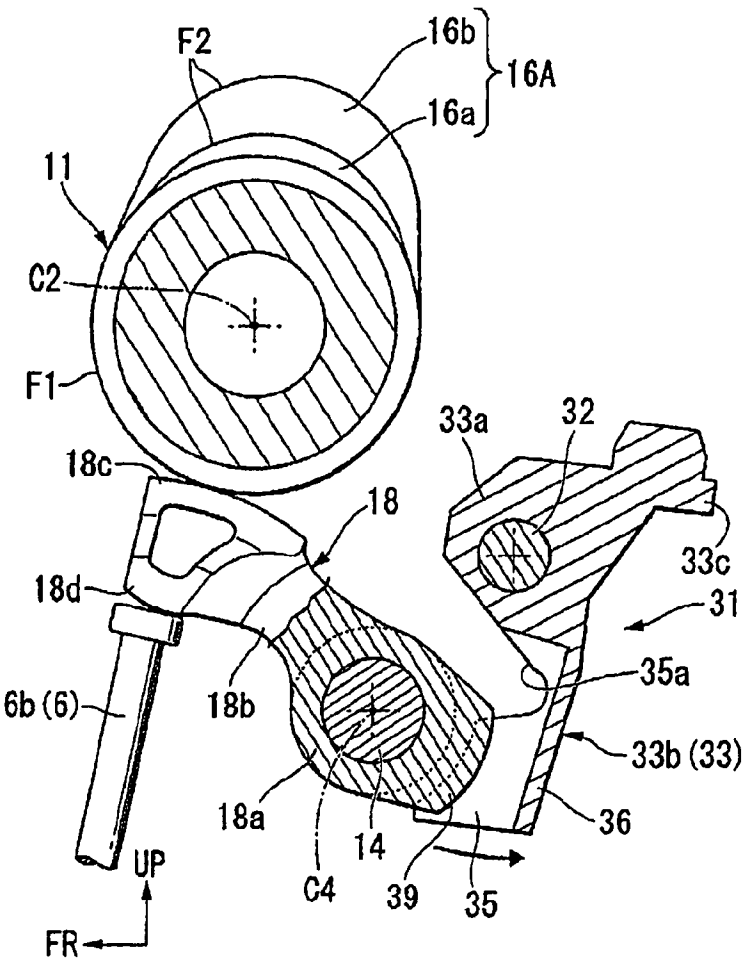
FIG. 10(*a*) is a cross-sectional view corresponding to FIG. 4(*a*) and showing the first manner of operation of the variable valve adjustment mechanism, and FIG. 10(*b*) is a cross-sectional view corresponding to FIG. 4(*b*) and showing the first manner of operation of the variable valve adjustment mechanism.
Figure 10A:
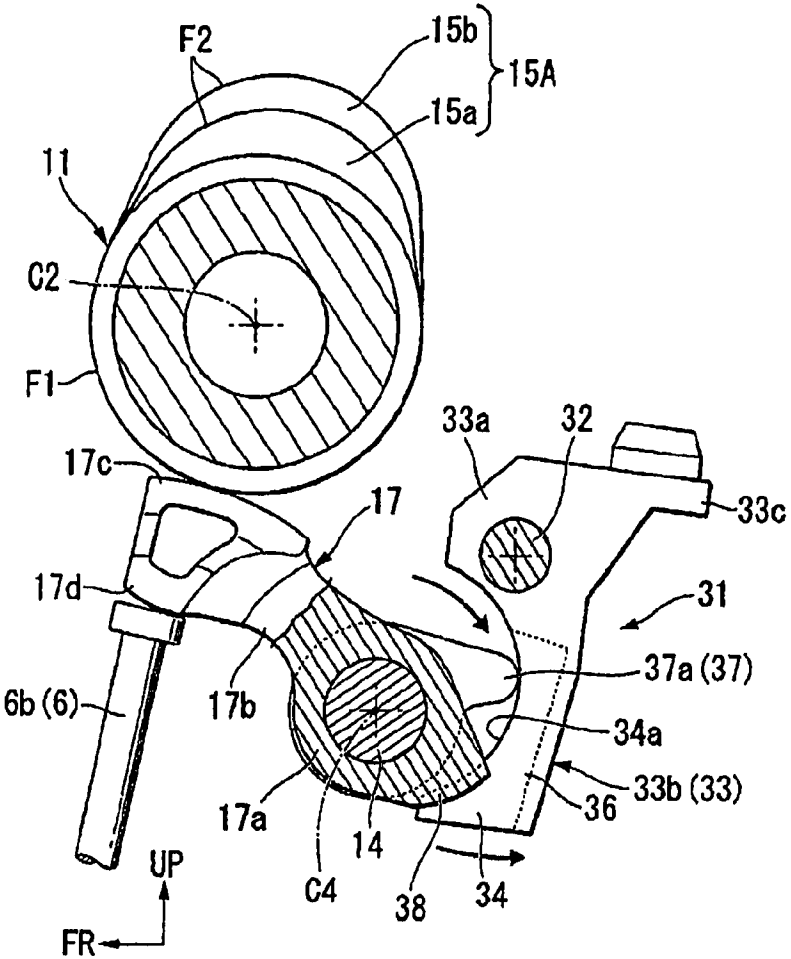

The center collar 37 is also rotated integrally (see FIG. 10(*a*)) along with the rotation of the rocker arm shaft 14. At the same time, a position of the center collar 37 may be slidably adjusted in the axial direction with respect to the rocker arm shaft 14, depending on the combination of the central slot 14*a* and the engaging pin 37*d*.

Figure 9:
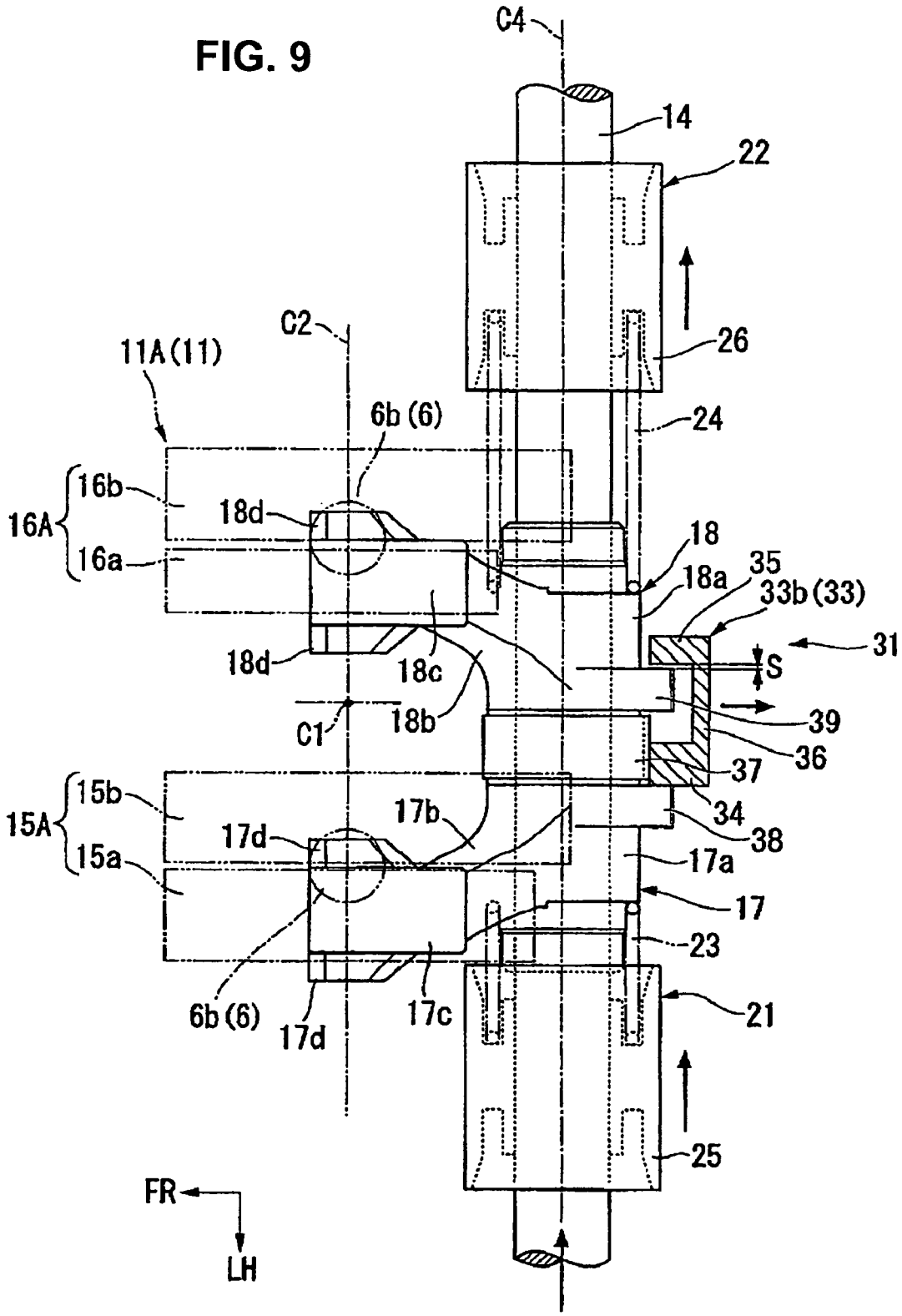
FIG. 9 is a top plan view corresponding to FIG. 2 and showing the first manner of operation of the variable valve adjustment mechanism.

Further, such that the left and right rocker arms 17, 18 are at the first operation position, to allow the first rocker arm moving mechanism 21 to store a predetermined force for moving the left and right rocker arms 17, 18 to the second operation position, first of all, as shown in FIG. 9, the shaft drive mechanism 41 is operated so as to move the rocker arm shaft 14 at the leftward-movement limit position in the rightward direction together with the respective spring-receiving collars 25, 26.

Here, since a lower portion of the left rocker-side key portion 38 of the left rocker arm 17 and a lower portion of the left trigger-side key portion 34 of the trigger arm 33 overlap each other with a predetermined overlapping quantity as viewed in the above-mentioned axial direction, the lower portion of the left rocker-side key portion 38 and the lower portion of the left trigger-side key portion 34 are brought into contact with each other in the axial direction so that the rightward-movement of the left and right rocker arms 17, 18 at the portions relative to the trigger arm 33 (cylinder head 2) is restricted.

Here, although a rear portion of the right rocker-side key portion 39 of the right rocker arm 18 and a lower portion of the right trigger-side key portion 35 of the trigger arm 33 overlap each other with a predetermined overlapping quantity as viewed in the axial direction, a predetermined gap S is defined, in the axial direction, between the rear portion of the right rocker-side key portion 39 and the lower portion of the right trigger-side key portion 35.

To explain the above-mentioned arrangement also in conjunction with FIG. 10, the rocker arm shaft 14 is rotated about an axis thereof in the clockwise direction, as shown in FIG. 10 and other drawings, along with the movement thereof in the rightward direction. When the center collar 37 is rotated in the clockwise direction along with the rotation of the rocker arm shaft 14, an outer peripheral surface formed on a distal end of the center cam portion 37*a* is brought into slidable contact with an upper inner peripheral surface of a notched portion 34*a* of the left trigger-side key portion 34 of the trigger arm 33 in the above-mentioned pre-rocking state and hence, the trigger arm 33 is rotated in the counter-clockwise direction shown in FIG. 10 and other drawings, against a biasing force of the spring 33*d*.

Then, at a point of time when the rocker arm shaft 14 is moved to the above-mentioned rightward-movement limit position, and the rotation of the center collar 37 (brought about by the movement of the rocker arm shaft 14) and the rotation of the trigger arm 33 (brought about by the rotation of the center collar 37) are finished, the lower portion of the left rocker-side key portion 38 and the lower portion of the left trigger-side key portion 34 overlap each other while reducing an overlapping margin as viewed in the axial direction and, at the same time, the rear portion of the right rocker-side key portion 39 and the lower portion of the right trigger-side key portion 35 also assume an overlapping state while reducing an overlapping margin as viewed in the axial direction, in substantially the same manner. Here, a lower portion of the notched portion 35*a* of the right trigger-side key portion 35 assumes an arcuate shape substantially coaxial with the rocker arm shaft 14 as viewed in the axial direction. This state of the trigger arm 33 is referred to as a first rocking state of the trigger arm 33.

At a point of time that the rocker arm shaft 14 and the respective spring-receiving collars 25, 26 are moved to the rightward-movement limit position from the leftward-movement limit position as described above, the first spring 23 which is positioned between the first spring-receiving collar 25 and a proximal portion 17*a* of the left rocker arm 17 whose movement is restricted is compressed by a predetermined quantity and hence, the first spring 23 assumes a state in which a resilient force sufficient for moving the left and right rocker arms 17, 18 to the second operation position from the first operation position is stored in the first spring 23.

Figure 11B:
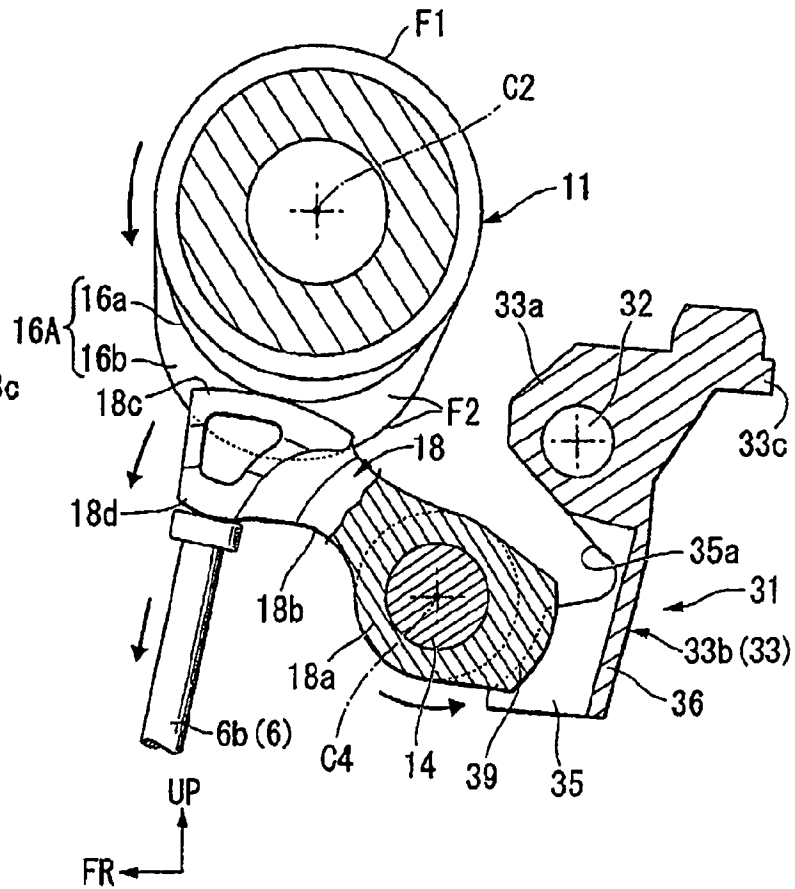
FIG. 11(*a*) is a cross-sectional view corresponding to FIG. 4(*a*) and showing the second manner of operation of the variable valve adjustment mechanism, and FIG. 11(*b*) is a cross-sectional view corresponding to FIG. 4(*b*) and showing the second manner of operation of the variable valve adjustment mechanism.
Figure 11A:
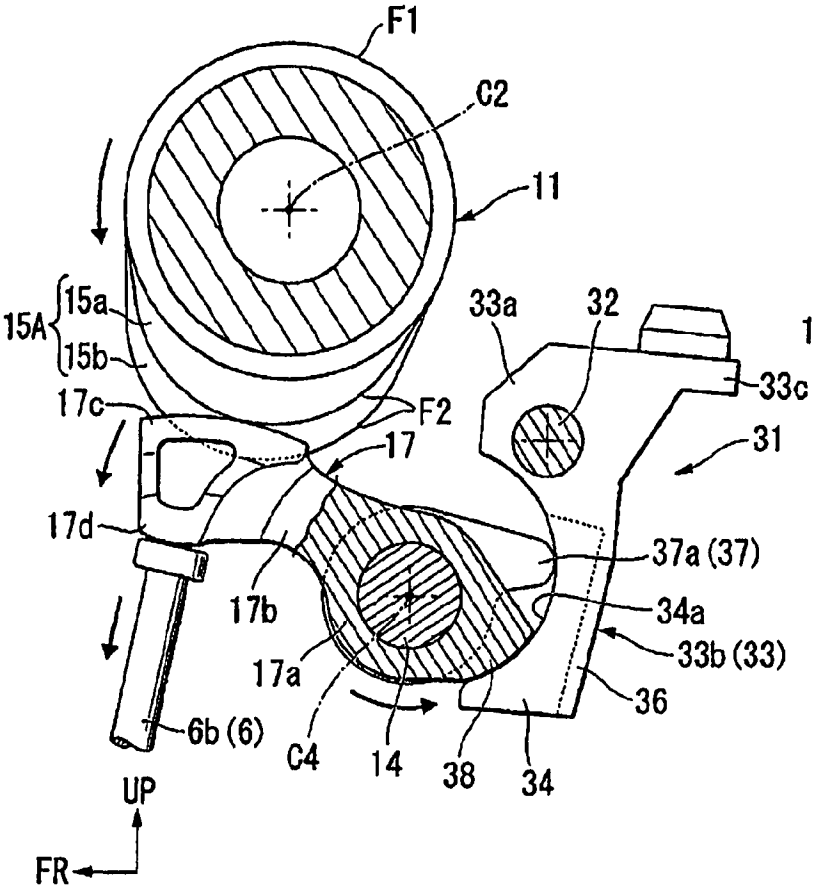

Then, assume that the left and right rocker arms 17, 18 are at the first operation position, the rocker arm shaft 14 is at the rightward movement limit position, and the trigger arm 33 is in the above-mentioned first rocking state. As shown in FIG. 11, the left and right first cams 15*a*, 16*a* rock the left and right rocker arms 17, 18 to a valve opening side from a valve closing side by rotatably driving the intake-side camshaft 11 (when the left and right cams 15*a*, 16*a* push the left and right rocker arms 17, 18 for lifting the left and right intake valves 6), for example, during a predetermined valve operation period which spans a point of time that the left and right intake valves 6 assume the maximum lift, an overlapping margin between the lower portion of the left rocker-side key portion 38 and the lower portion of the left trigger-side key portion 34 as viewed in the axial direction becomes 0 (the contact margin in the axial direction is eliminated) and hence, the restriction on the rightward-movement of the left and right rocker arms 17, 18 relative to the cylinder head 2 at the portions is removed.

Here, even when the left and right rocker arms 17, 18 are rocked when the trigger arm 33 assumes the above-mentioned pre-rocking state, the overlapping margin of the left rocker-side key portion 38 and the left trigger-side key portion 34 does not become 0. Accordingly, until the trigger arm 33 assumes the above-mentioned first rocking state (that is, until the first spring 23 acquires a predetermined force storing state), the restriction on the rightward movement of the left and right rocker arms 17, 18 are maintained.

Figure 12B:
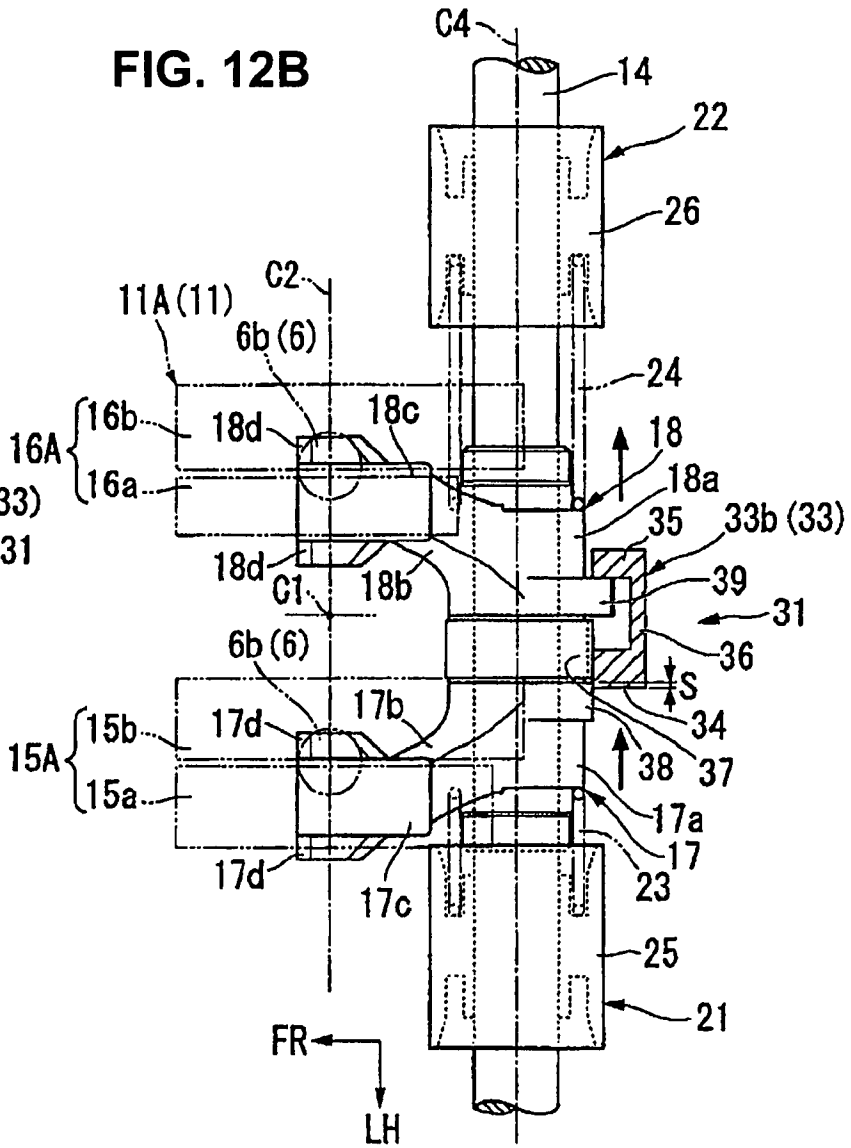
FIG. 12(*a*) is a top plan view corresponding to FIG. 2 and showing the second manner of operation of the variable valve adjustment mechanism, and FIG. 12(*b*) is a top plan view corresponding to FIG. 2 and showing the third manner of operation of the variable valve adjustment mechanism.
Figure 12A:
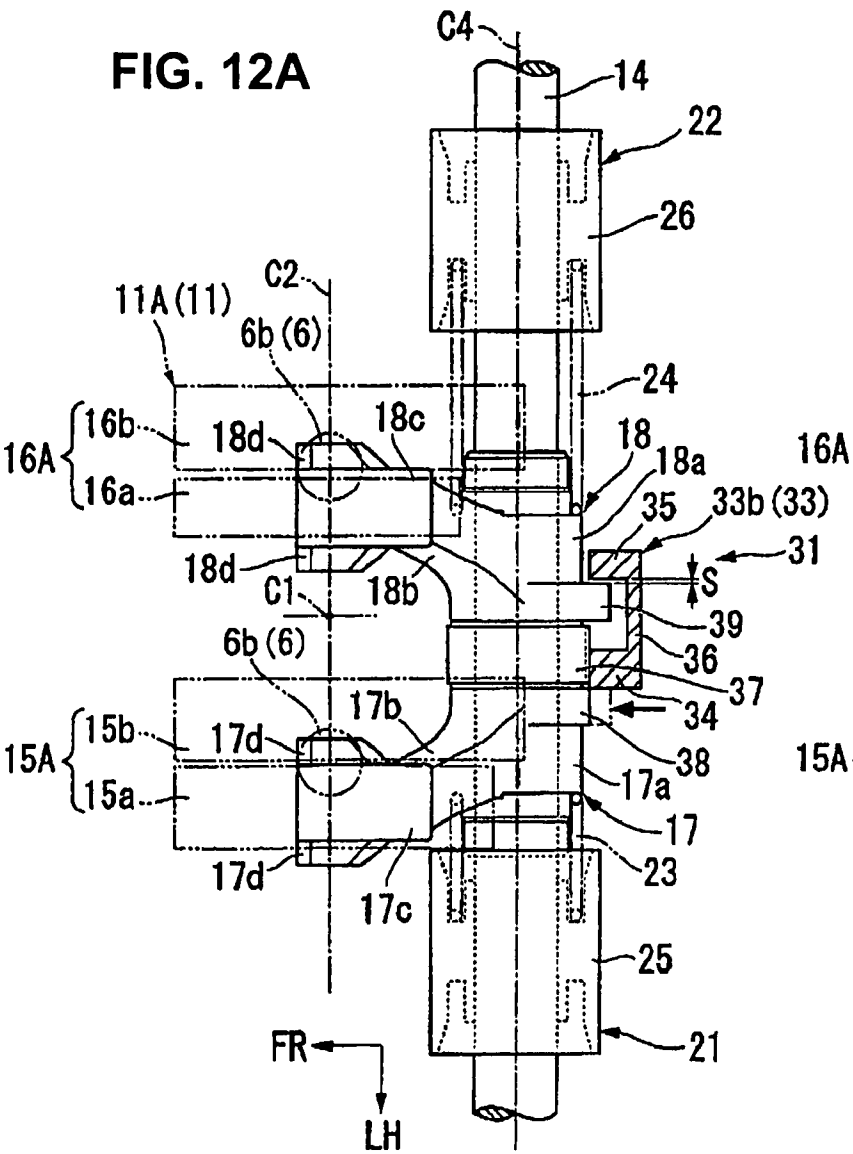

On the other hand, the overlapping margin of the rear portion of the right rocker-side key portion 39 and the lower portion of the right trigger-side key portion 35 as viewed in the axial direction is, since the above-mentioned portions are formed coaxially with the rocker arm shaft 14, hardly increased or decreased even when the left and right rocker arms 17, 18 rock. Accordingly, to explain the above-mentioned arrangement also in conjunction with FIG. 12, when the restriction on the rightward-movement of the left and right rocker arms 17, 18 between the left rocker-side key portion 38 and the left trigger-side key portion 34 is removed as described above, the left and right rocker arms 17, 18 (and the center collar 37) are moved in the rightward direction by a quantity corresponding to the above-mentioned gap S defined between the right rocker-side key portion 39 and the right trigger-side key portion 35.

Here, by bringing the rear portion of the right rocker-side key portion 39 and the lower portion of the right trigger-side key portion 35 into contact with each other in the axial direction, the rightward movement of the left and right rocker arms 17, 18 relative to the cylinder head 2 is restricted. Here, the lower portion of the left rocker-side key portion 38 and the lower portion of the left trigger-side key portion 34 overlap each other by a quantity corresponding to the above-mentioned gap S in the axial direction.

Figure 13B:
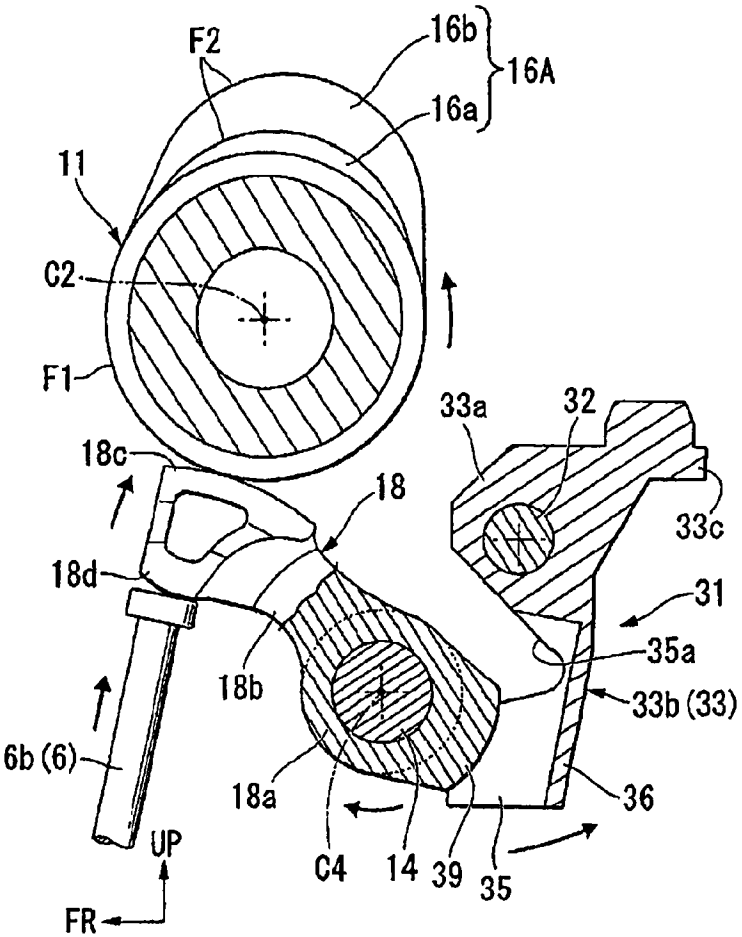
FIG. 13(*a*) is a cross-sectional view corresponding to FIG. 4(*a*) and showing the fourth manner of operation of the variable valve adjustment mechanism, and FIG. 13(*b*) is a cross-sectional view corresponding to FIG. 4(*b*) and showing the fourth manner of operation of the variable valve adjustment mechanism.
Figure 13A:
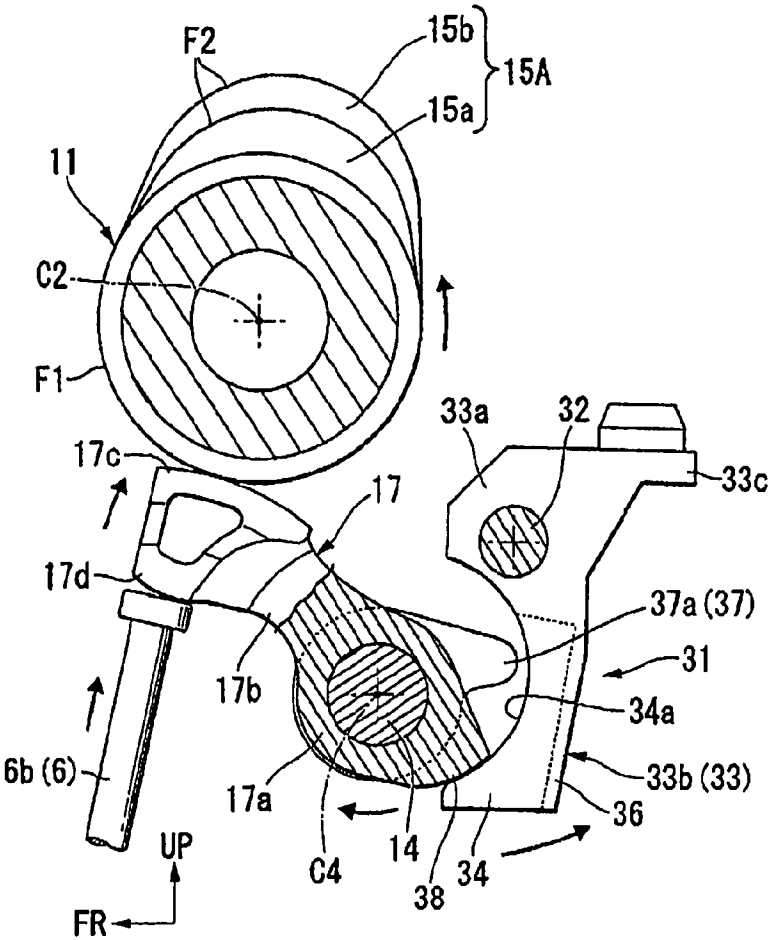

Then, such that the left rocker-side key portion 38 and the left trigger-side key portion 34 overlap each other by a predetermined overlapping quantity in the axial direction as described above, when the left and right rocker arms 17, 18 are rocked or pivoted from a valve opening side to the valve closing side due to the continuous rotary driving of the intake-side camshaft 11, as shown in FIG. 13, a lower outer peripheral surface of the left rocker-side key portion 38 is brought into slide contact with a lower inner peripheral surface of the notched portion 34*a* of the left trigger-side key portion 34 and hence, the trigger arm 33 is further rotated in the counter-clockwise direction shown in FIG. 13 and other drawings from the above-mentioned first rocking state.

Figure 14B:
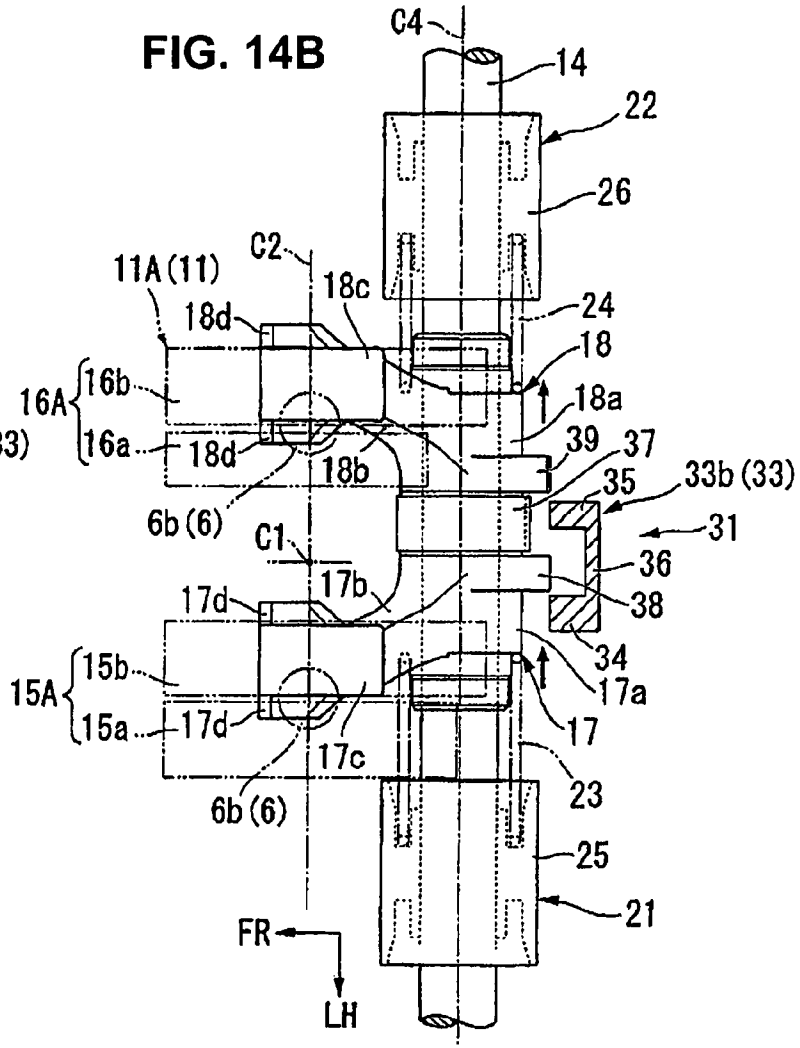
FIG. 14(*a*) is a top plan view corresponding to FIG. 2 and showing the fourth manner of operation of the variable valve adjustment mechanism, and FIG. 14(*b*) is a top plan view corresponding to FIG. 2 and showing the fifth manner of operation of the variable valve adjustment mechanism.
Figure 14A:
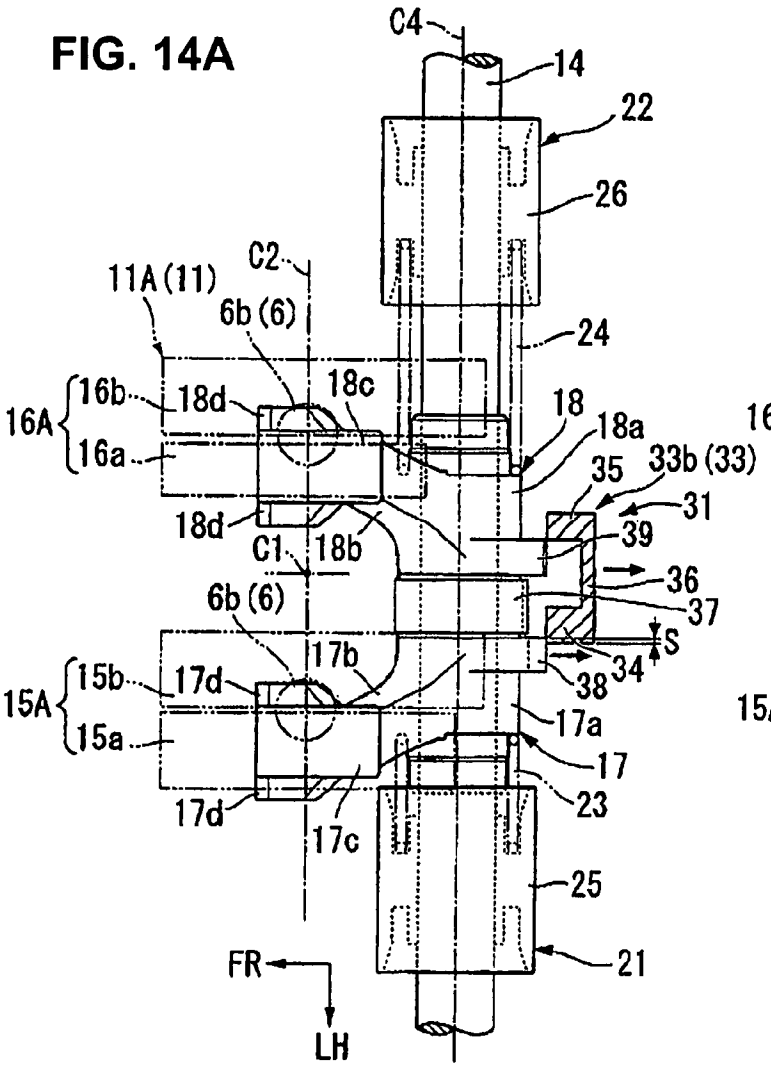

Further, to explain the above-mentioned arrangement also in conjunction with FIG. 14, at a point of time that the left and right rocker arms 17, 18 are rocked to a state in which a lift quantity of the intake valve 6 assumes 0 (valve full-closed state), an overlapping margin between a rear portion of the right rocker-side key portion 39 and a lower portion of the right trigger-side key portion 35 as viewed in the axial direction becomes 0 (a contact margin in the axial direction is eliminated) and hence, the restriction on the rightward-movement of the left and right rocker arms 17, 18 relative to the cylinder head 2 at the portions is removed.

Here, the restriction on the movement of the left and right rocker arms 17, 18 between the left rocker-side key portion 38 and the left trigger-side key portion 34 is also removed and hence, the left and right rocker arms 17, 18 (and the center collar 37) can be moved in the rightward direction whereby the left and right rocker arms 17, 18 are moved to the second operation position due to a resilient force stored in the first spring 23.

When the movement of the left and right rocker arms 17, 18 to the second operation position is completed, the left and right rocker-side key portions 38, 39 and the left and right trigger-side key portions 34, 35 no longer overlap each other in the axial direction respectively and hence, the trigger arm 33 is rotated in the clockwise direction shown in FIG. 13 and other drawings due to a biasing force of the spring 33*d* and returns to the above-mentioned pre-rocking state.

Figure 15:
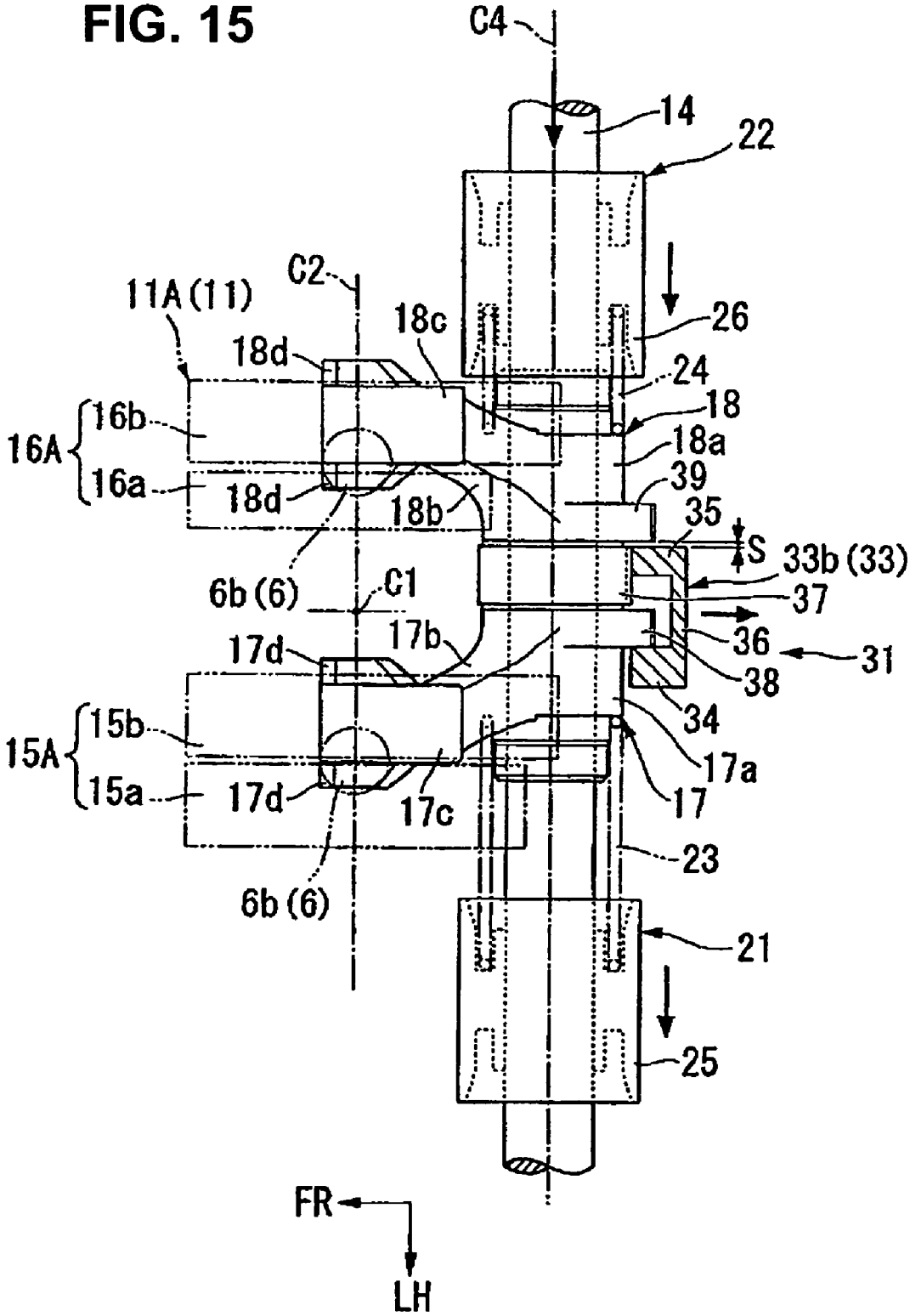
FIG. 15 is a top plan view corresponding to FIG. 3 and showing the sixth manner of operation of the variable valve adjustment mechanism.

Next, such that the left and right rocker arms 17, 18 are at the second operation position, to allow the second rocker arm moving mechanism 22 to store a predetermined force for moving the left and right rocker arms 17, 18 to the first operation position, first of all, as shown in FIG. 15, the shaft drive mechanism 41 (in FIG. 22) is operated so as to move the rocker arm shaft 14 at the rightward-movement limit position in the leftward direction together with the respective spring-receiving collars 25, 26.

Here, since a lower portion of the left rocker-side key portion 38 of the left rocker arm 17 and a lower portion of the left trigger-side key portion 34 of the trigger arm 33 overlap each other with a predetermined overlapping quantity as viewed in the above-mentioned axial direction, the lower portion of the left rocker-side key portion 38 and the lower portion of the left trigger-side key portion 34 are brought into contact with each other in the axial direction so that the leftward-movement of the left and right rocker arms 17, 18 at the portions relative to the trigger arm 33 (cylinder head 2) is restricted.

Here, although a rear portion of right rocker-side key portion 39 of the right rocker arm 18 and a lower portion of the right trigger-side key portion 35 of the trigger arm 33 overlap each other with a predetermined overlapping quantity as viewed in the axial direction, the above-mentioned gap S is defined between the rear portion of the right rocker-side key portion 39 and the right trigger-side key portion 35.

Figure 16B:
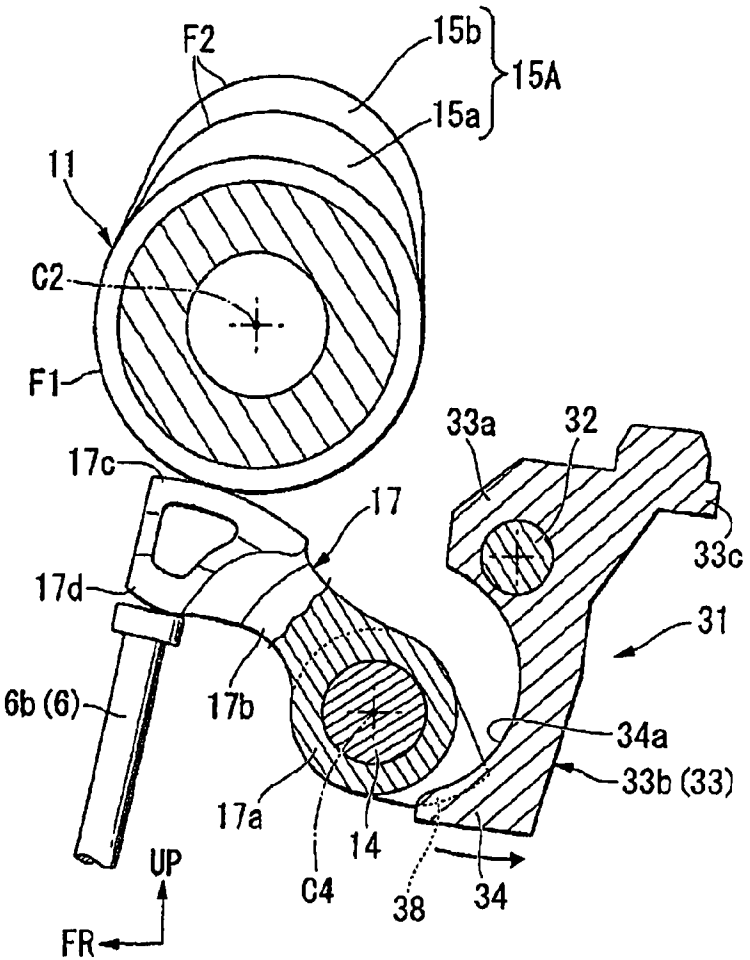
FIG. 16(*a*) is a cross-sectional view corresponding to FIG. 5(*a*) and showing the sixth manner of operation of the variable valve adjustment mechanism, and FIG. 16(*b*) is a cross-sectional view corresponding to FIG. 5(*b*) and showing the sixth manner of operation of the variable valve adjustment mechanism.
Figure 16A:
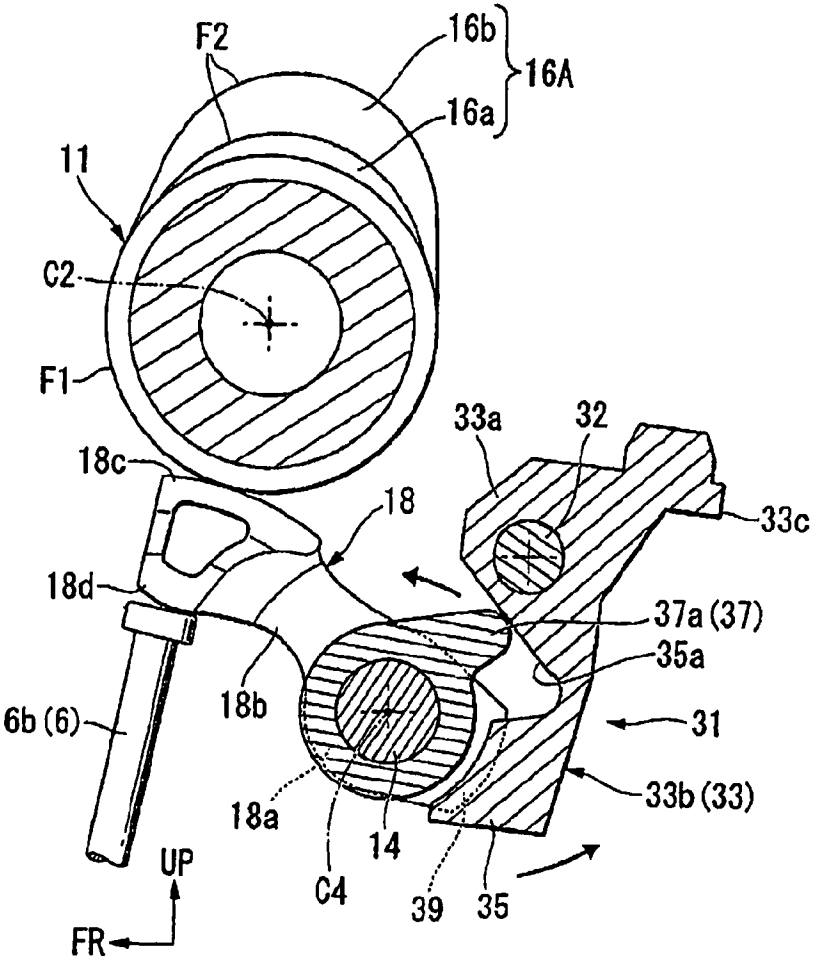

To explain the above-mentioned arrangement also in conjunction with FIG. 16, the rocker arms shaft 14 is rotated in the counter-clockwise direction shown in FIG. 16 and other drawings about an axis thereof along with the movement thereof in the leftward direction. When the center collar 37 is rotated in the counter-clockwise direction shown in FIG. 16 and other drawings along with the rotation of the rocker arm shaft 14, an outer peripheral surface formed on a distal end of the center cam portion 37*a* is brought into slidable contact with an upper inner peripheral surface of a notched portion 35*a* of the right trigger-side key portion 35 of the trigger arm 33 in the above-mentioned pre-rocking state and hence, the trigger arm 33 is rotated in the counter-clockwise direction shown in FIG. 16 and other drawings against a biasing force of the spring 33*d*.

Then, at a point of time that the rocker arm shaft 14 is moved to the above-mentioned leftward-movement limit position, and the rotation of the center collar 37 brought about by the movement of the rocker arm shaft 14 and the rotation of the trigger arm 33 brought about by the rotation of the center collar 37 are finished, the lower portion of the left rocker-side key portion 38 and the lower portion of the left trigger-side key portion 34 overlap each other while reducing an overlapping margin as viewed in the axial direction and, at the same time, the rear portion of the right rocker-side key portion 39 and the rear portion of the right trigger-side key portion 35 also assume an overlapping state while reducing an overlapping margin as viewed in the axial direction in the same manner. Here, a lower portion of the notched portion 35*a* of the right trigger-side key portion 35 assumes an arcuate shape substantially coaxial with the rocker arm shaft 14 as viewed in the axial direction and hence, the trigger arm 33 assumes the above-mentioned first rocking state.

At a point of time that the rocker arm shaft 14 and the respective spring-receiving collars 25, 26 are moved to the leftward-movement limit position from the rightward-movement limit position as described above, the second spring 24 which is positioned between the second spring-receiving collar 26 and a proximal portion 18*a* of the right rocker arm 18 whose movement is restricted is compressed by a predetermined quantity and hence, the second spring 24 assumes a state in which a resilient force sufficient for moving the left and right rocker arms 17, 18 to the first operation position from the second operation position is stored in the second spring 24.

Figure 17B:
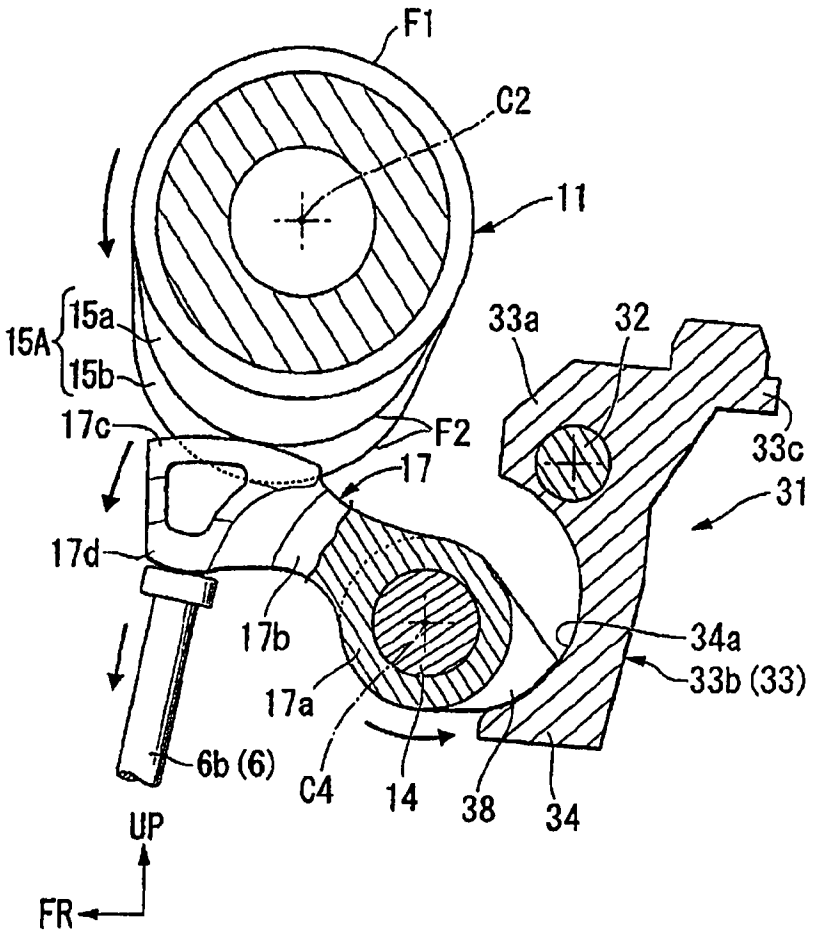
FIG. 17(*a*) is a cross-sectional view corresponding to FIG. 5(*a*) and showing the seventh manner of operation of the variable valve adjustment mechanism, and FIG. 17(*b*) is a cross-sectional view corresponding to FIG. 5(*b*) and showing the seventh manner of operation of the variable valve adjustment mechanism.
Figure 17A:
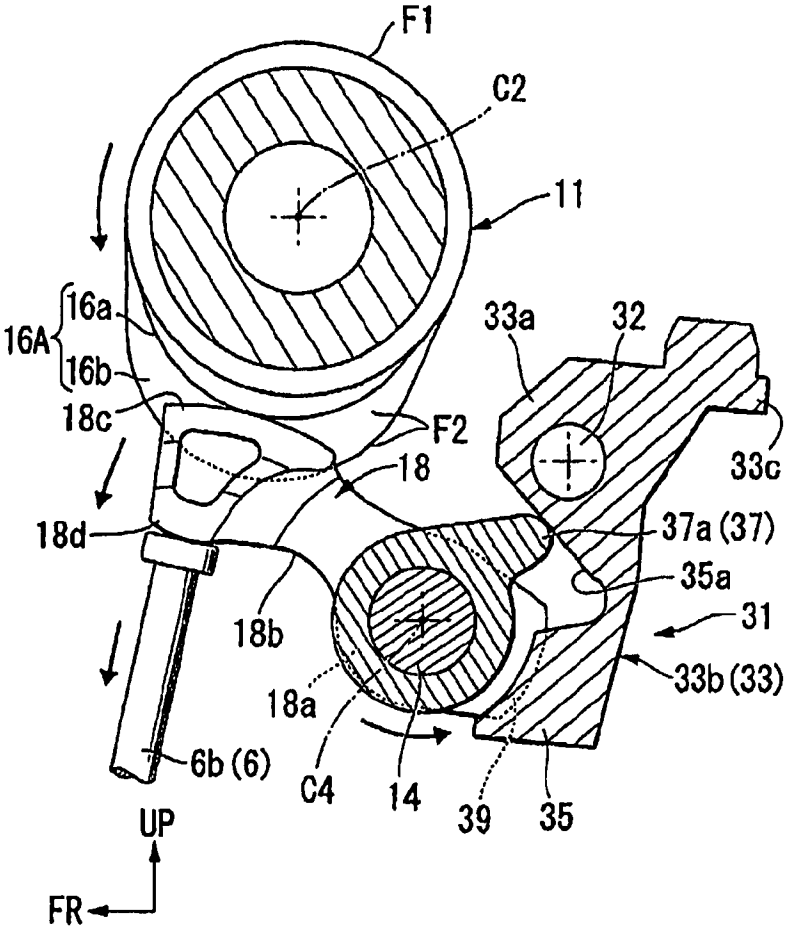

Then, assume that the left and right rocker arms 17, 18 are at the second operation position, the rocker arm shaft 14 is at the leftward movement limit position, and the trigger arm 33 is in the above-mentioned first rocking state. As shown in FIG. 17, the left and right second cams 15*b*, 16*b* rock the left and right rocker arms 17, 18 to a valve opening side from a valve closing side by rotatably driving the intake-side camshaft 11 downward, for example, during a predetermined valve operation period which spans a point of time that the left and right intake valves 6 assume the maximum lift, an overlapping margin between the lower portion of the left rocker-side key portion 38 and the lower portion of the left trigger-side key portion 34 as viewed in the axial direction becomes 0 and hence, the restriction on the leftward-movement of the left and right rocker arms 17, 18 relative to the cylinder head 2 at the portions is removed.

Here, even when the left and right rocker arms 17, 18 are rocked when the trigger arm 33 assumes the above-mentioned pre-rocking state, the overlapping margin of the left rocker-side key portion 38 and the left trigger-side key portion 34 does not become 0. Accordingly, until the trigger arm 33 assumes the above-mentioned first rocking state (that is, until the second spring 24 acquires a predetermined force storing state), the restriction on the leftward movement of the left and right rocker arms 17, 18 are maintained.

Figure 18B:
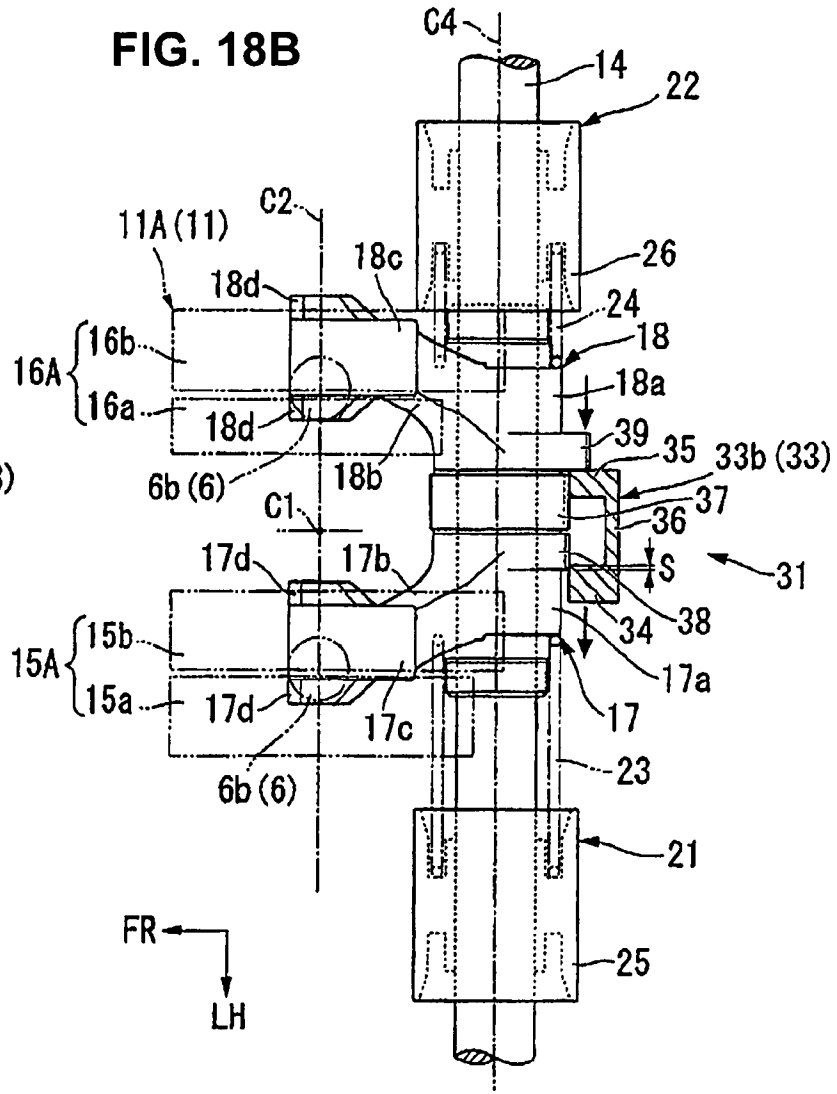
FIG. 18(*a*) is a top plan view corresponding to FIG. 3 and showing the seventh manner of operation of the variable valve adjustment mechanism, and FIG. 18(*b*) is a top plan view corresponding to FIG. 3 and showing the eighth manner of operation of the variable valve adjustment mechanism.
Figure 18A:
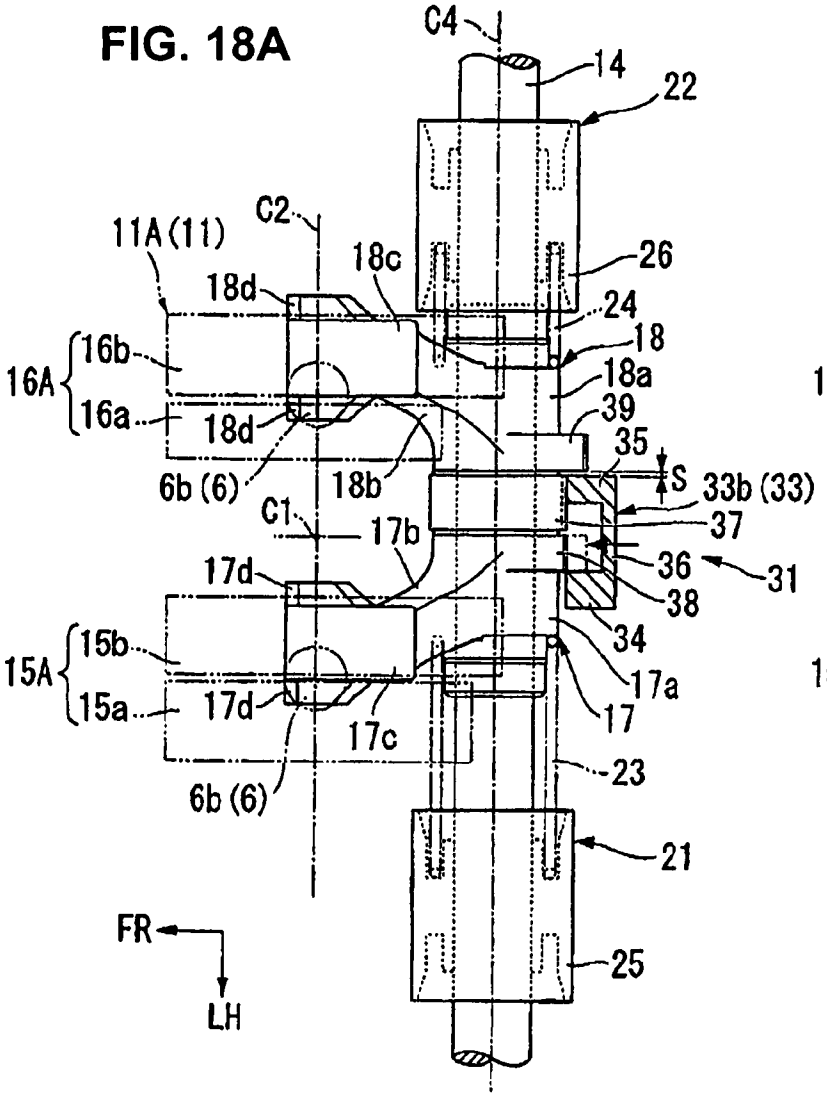

On the other hand, the overlapping margin of the rear portion of the right rocker-side key portion 39 and the lower portion of the right trigger-side key portion 35 as viewed in the axial direction is hardly increased or decreased even when the left and right rocker arms 17, 18 rock. Accordingly, to explain the above-mentioned arrangement also in conjunction with FIG. 18, when the restriction on the leftward-movement of the left and right rocker arms 17, 18 between the left rocker-side key portion 38 and the left trigger-side key portion 34 is removed as described above, the left and right rocker arms 17, 18 are moved in the leftward direction by a quantity corresponding to the above-mentioned gap S.

Here, by bringing the rear portion of the right rocker-side key portion 39 and the lower portion of the right trigger-side key portion 35 into contact with each other in the axial direction, the leftward movement of the left and right rocker arms 17, 18 relative to the cylinder head 2 is restricted. Here, the lower portion of the left rocker-side key portion 38 and the lower portion of the left trigger-side key portion 34 overlap each other by a quantity corresponding to the above-mentioned gap S in the axial direction.

Figure 19B:
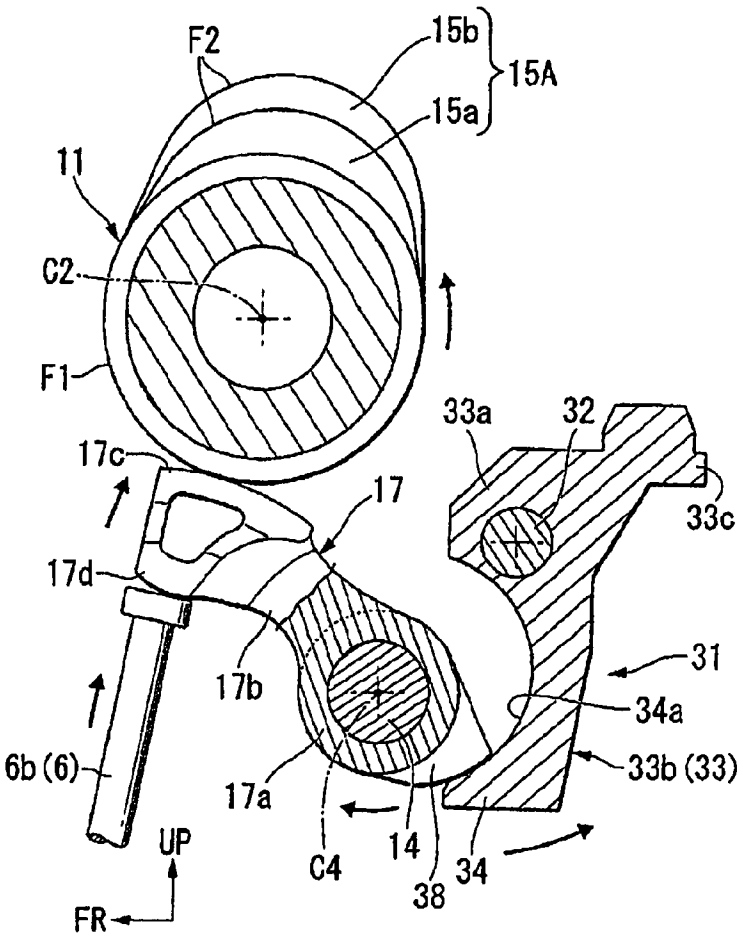
FIG. 19(*a*) is a cross-sectional view corresponding to FIG. 5(*a*) and showing the ninth manner of operation of the variable valve adjustment mechanism, and FIG. 19(*b*) is a cross-sectional view corresponding to FIG. 5(*b*) and showing the fifth manner of operation of the variable valve adjustment mechanism.
Figure 19A:
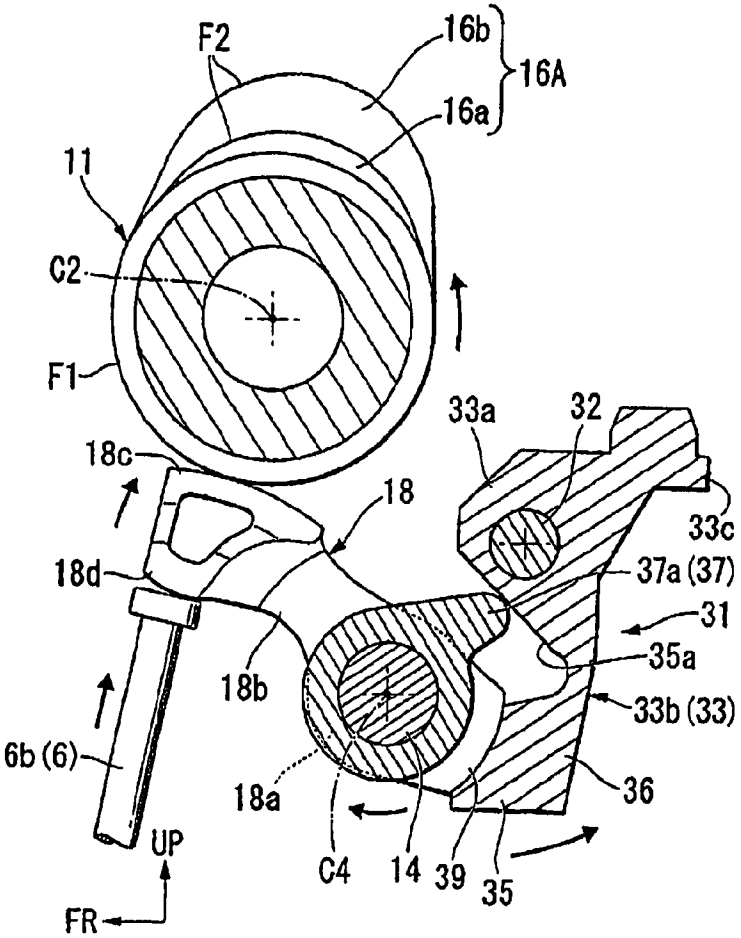

Then, such that the left rocker-side key portion 38 and the left trigger-side key portion 34 overlap each other by a predetermined overlapping quantity in the axial direction as described above, when the left and right rocker arms 17, 18 are rocked from a valve opening side to the valve closing side due to the continuous rotary driving of the intake-side camshaft 11, as shown in FIG. 19, an outer peripheral surface of a lower portion of the left rocker-side key portion 38 is brought into slide contact with a lower inner peripheral surface of the notched portion 34*a* of the left trigger-side key portion 34 and hence, the trigger arm 33 is further rotated in the counter-clockwise direction shown in FIG. 19 and other drawings from the above-mentioned first rocking state.

Figure 20B:
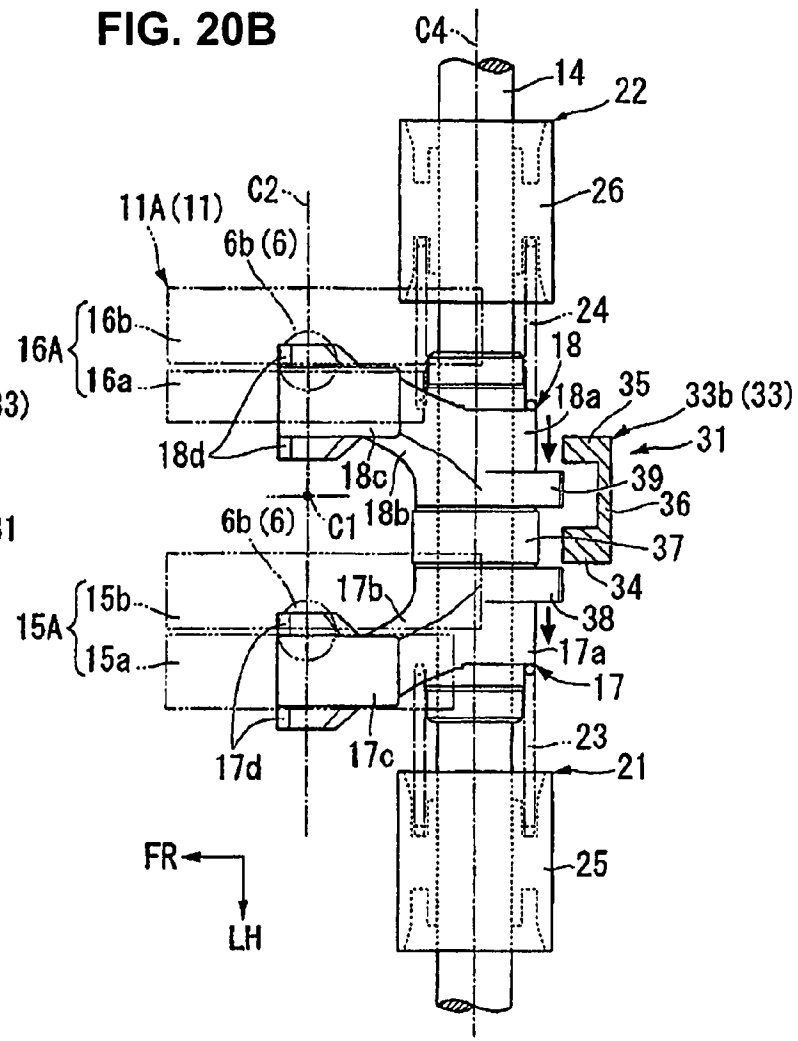
FIG. 20(*a*) is a top plan view corresponding to FIG. 3 and showing the ninth manner of operation of the variable valve adjustment mechanism, and FIG. 20(*b*) is a top plan view corresponding to FIG. 3 and showing the tenth manner of operation of the variable valve adjustment mechanism.
Figure 20A:
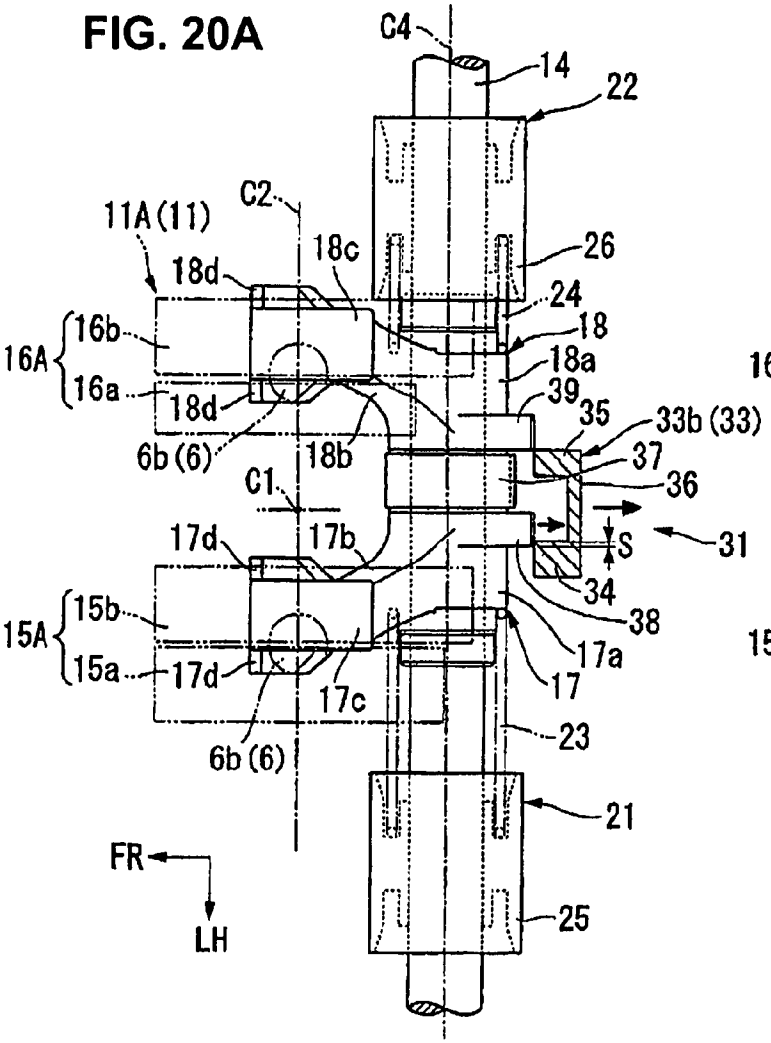

Further, to explain the above-mentioned arrangement in conjunction with FIG. 20, at a point of time that the left and right rocker arms 17, 18 are rocked to a state in which a lift quantity of the intake valve 6 assumes 0, a rear portion of the right rocker-side key portion 39 and a lower portion of the right trigger-side key portion 35 overlap each other as viewed in the axial direction with an overlapping margin of 0 and hence, the restriction on the leftward-movement of the left and right rocker arms 17, 18 at the portions relative to the cylinder head 2 is removed.

Here, the restriction on the movement of the left and right rocker arms 17, 18 between the left rocker-side key portion 38 and the left trigger-side key portion 34 is also removed and hence, the left and right rocker arms 17, 18 (and the center collar 37) can be moved in the leftward direction whereby the left and right rocker arms 17, 18 are moved to the first operation position due to a resilient force stored in the second spring 24.

When the movement of the left and right rocker arms 17, 18 to the first operation position is completed, the left and right rocker-side key portions 38, 39 and the left and right trigger-side key portions 34, 35 no longer overlap each other in the axial direction respectively and hence, the trigger arm 33 is rotated in the clockwise direction shown in FIG. 19 and other drawings due to a biasing force of the spring 33*d* (see FIG. 1) and returns to the above-mentioned pre-rocking state.

In this manner, by suitably changing (varying) the actuation (opening/closing) timing or the valve lift quantity of the intake valve 6 depending on whether the rotary speed of the engine 1 (rotary speed of the crankshaft) is in a stop or low-speed rotary range or in a high-speed rotary range, it is possible to reduce a valve overlapping quantity and to suppress a lift quantity in the low-speed rotary range of the engine 1, while it is possible to increase the valve overlapping quantity and the lift quantity in the high-rotary range of the engine 1. Here, it is needless to say that a variable valve adjustment mechanism similar to the above-mentioned variable valve adjustment mechanism may be also applied to an exhaust side of the engine. In this case, it is possible to realize efficient intake and exhaust operations at respective rotary ranges of the engine 1.

Figure 21:
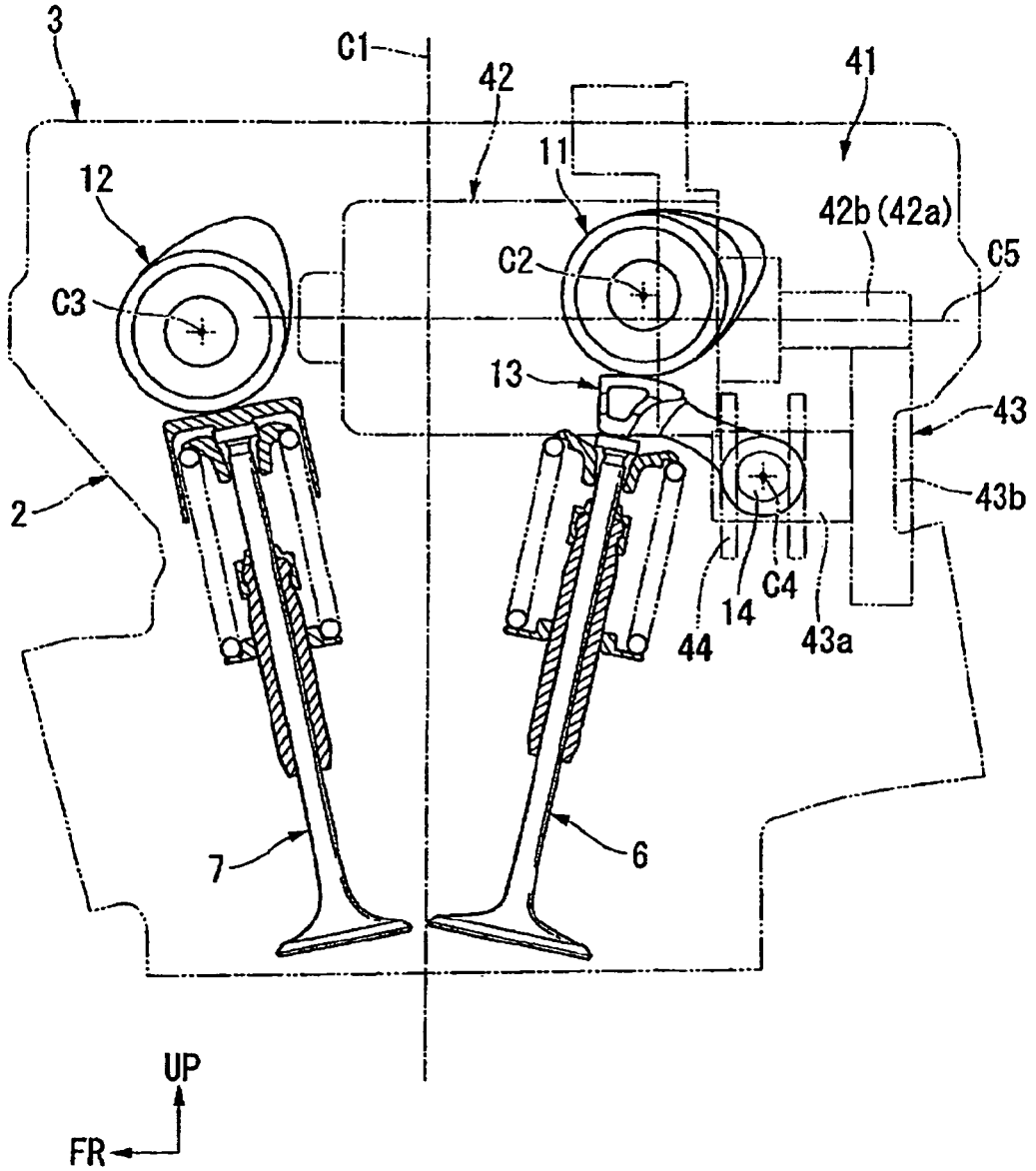
FIG. 21 is a left side view corresponding to FIG. 1 and showing a shaft drive mechanism of the variable valve adjustment mechanism.
Figure 22:
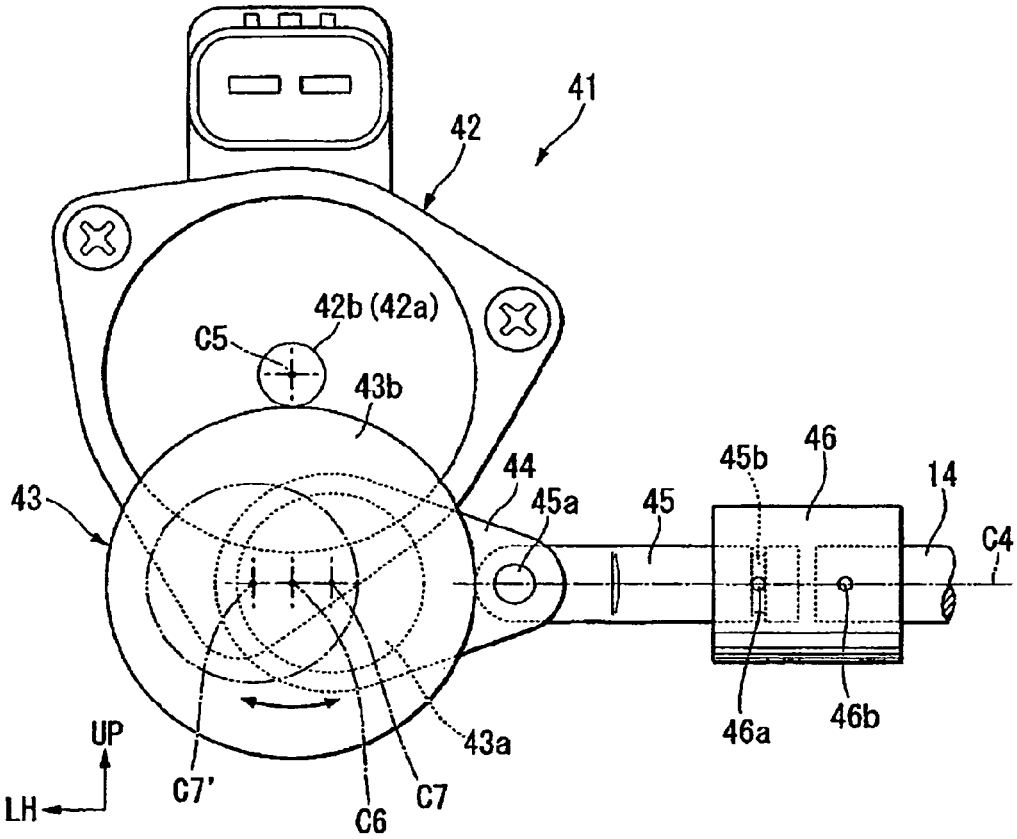
FIG. 22 is a rear surface view of an essential part of the shaft drive mechanism.

As shown in FIG. 21 and FIG. 22, the shaft drive mechanism 41 includes an electrically-operated motor 42 which constitutes a drive source, a speed-reduction gear shaft 43 which is arranged parallel to a drive shaft 42*a* of the electrically-operated motor 42, and a connecting rod 44 which connects an eccentric shaft 43*a* of the speed-reduction gear shaft 43 and one end side of the rocker arm shaft 14.

The electrically-operated motor 42 is mounted on a left (or right)-side surface of the cylinder head 2, and is arranged to be orthogonal to a cylinder axis C1 when a drive shaft axis C5 is viewed in a side view. A drive gear 42*b* is formed on an outer periphery of the drive shaft 42*a* of the electrically operated motor 42, and the drive gear 42*b* is meshed with a large-diameter gear 43*b* mounted on one end side of the speed reduction gear shaft 43. A rotary drive force of the electrically-operated motor 42 is transmitted to the speed reduction gear shaft 43 with the speed reduction by way of the respective gears 42*b*, 43*b*, and the eccentric shaft 43*a* of the speed reduction gear shaft 43 is displaced laterally so as to allow the rocker arm shaft 14 to perform a stroke in the lateral direction (in the axial direction). Accordingly, a resilient force is stored in either one of the first rocker arm moving mechanism 21 and the second rocker arm moving mechanism 22. In FIG. 22, symbol C6 indicates a rotary center axis of the speed reduction gear shaft 43, symbol C7 indicates a center axis of the eccentric shaft 43*a* when the rocker arm shaft 14 is moved in the rightward direction, and symbol C7' indicates a center axis of the eccentric shaft 43*a* when the rocker arm shaft 14 is moved in the leftward direction.

Figure 23:
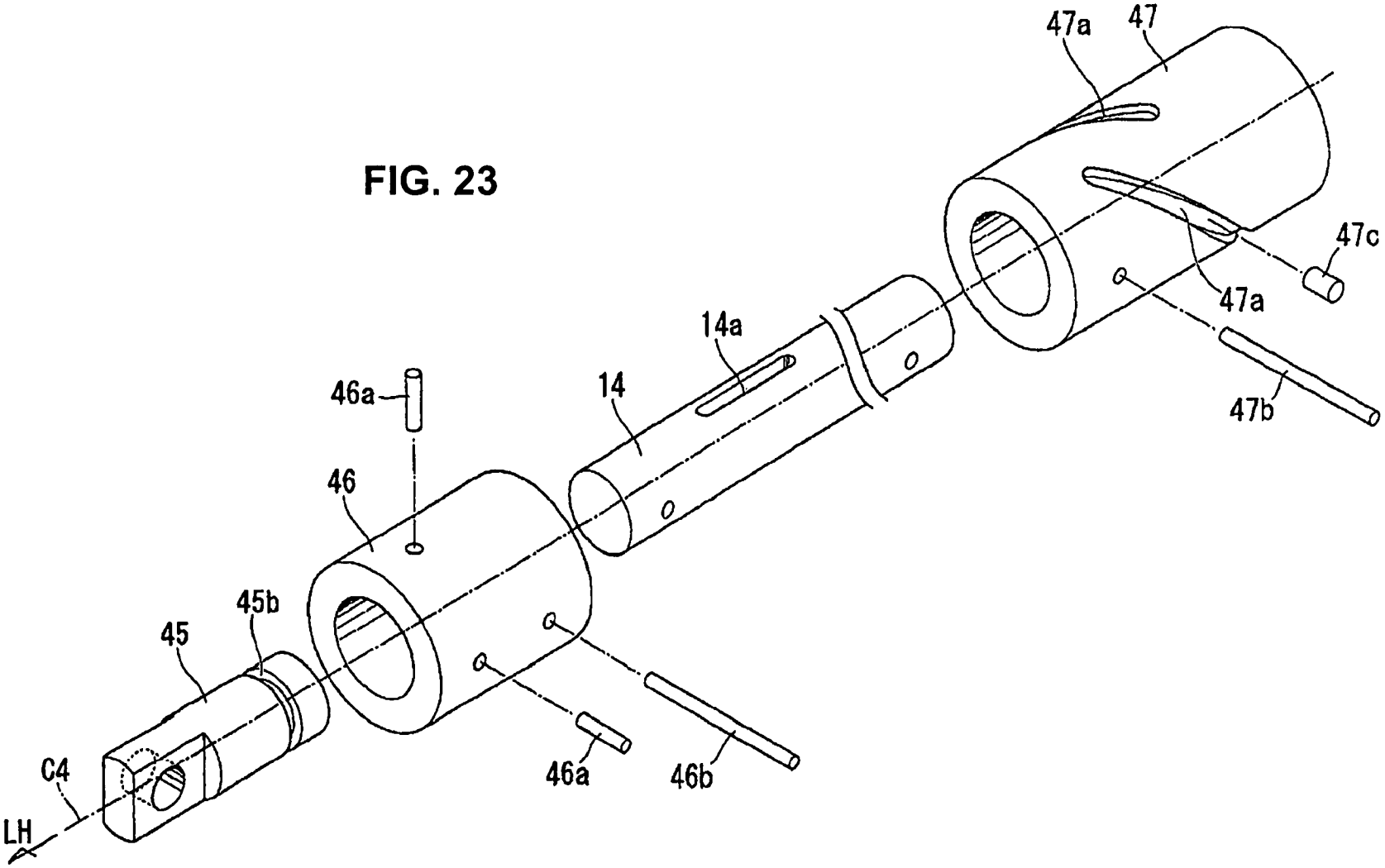
FIG. 23 is an exploded perspective view of the rocker arm shaft.

To explain the above-mentioned arrangement also in conjunction with FIG. 23, on one end portion of the rocker arm shaft 14, an end rod 45 coaxial with the rocker arm shaft 14 is mounted by way of an end collar 46. The end rod 45 has one end portion thereof rotatably connected to a distal end portion of the connecting rod 44 by way of a connecting pin 45*a* parallel to the eccentric shaft 43*a*, and has another end portion thereof held by the end collar 46 such that another end portion is not axially movable but is rotatable about an axis thereof.

The end collar 46 rotatably holds the end rod 45 about an axis thereof using a plurality of engaging pins 46*a*. On the other hand, the end collar 46 by way of a connecting pin 46*b*, which penetrates the rocker arm shaft 14, and the end collar 46 fixedly hold one end portion of the rocker arm shaft 14 in the radial direction. Here, in the drawing, symbol 45*b* indicates an engaging groove formed in an outer periphery of the end rod 45, which is engaged with engaging pins 46*a* formed on an inner periphery of the end collar 46 in a projecting manner. Further, the end collar 46 allows, in the same manner as the above-mentioned first spring-receiving collar 25, a left end portion of the first spring 23 to be fitted in a right-side inner periphery thereof. That is, the end collar 46 also functions as the first spring-receiving collar 25 of the left outer cylinder of the engine 1.

The rocker arm shaft 14 is formed of a single body, which extends astride the respective cylinders of the engine 1. For example, on another end portion of the rocker arm shaft 14, a rotary collar 47, which has formed therein, a helical engaging groove 47*a* in an outer periphery thereof, is fixedly mounted by way of a connecting pin 47*b* which penetrates the rocker arm shaft 14 and the rotary collar 47 in the radial direction.

The rotary collar 47 is inserted into and supported by a support hole not shown in the drawing, which is formed in the cylinder head 2 such that the rotary collar 47 is rotatable about an axis thereof and is axially movable. An engaging pin 47*c* which projects toward an inner periphery of the above-mentioned support hole are suitably engaged with the engaging groove 47*a* formed in the rotary collar 47. Due to such an arrangement, when the rocker arm shaft 14 performs a stroke, in response to such a stroke, the end collar 46, the rocker arm shaft 14, the rotary collar 47, the first spring-receiving collar 25, and the second spring-receiving collar 26 are suitably rotated. The rotary collar 47 allows, in the same manner as the second spring-receiving collar 26, a right end portion of the second spring 24 to be fitted in the left-side inner periphery thereof. That is, the rotary collar 47 also functions as the second spring-receiving collar 24 in the right outer cylinder of the engine 1.

As has been explained previously, the valve actuating mechanism 5 of the engine 1 according to the above-mentioned embodiment includes the intake-side camshaft 11 which includes the pair of first cams 15*a*, 16*a* and the second cams 15*b*, 16*b* for one intake valve 6, and the left and right rocker arms 17, 18 which are supported on the rocker arm shaft 14 which is arranged in parallel with the intake-side camshaft 11 such that the left and right rocker arms 17, 18 are pivotally movable about the axis of the rocker arm shaft 14 and are axially movable of the rocker arm shaft 14, wherein the left and right rocker arms 17, 18 can be brought into contact with either one of the respective cams 15*a*, 16*a*, 15*b*, 16*b* in response to the rotary driving of the intake-side camshaft 11 and are pivoted to open or close the intake valve 6, and the left and right rocker arms 17, 18 are moved to either one of the first operation position at which the left and right rocker arms 17, 18 can be brought into contact with the first cams 15*a*, 16*a* in the axial direction and the second operation position at which the left and right rocker arms 17, 18 can be brought into contact with the second cams 15*b*, 16*b* in the axial direction thus allowing the valve actuating mechanism 5 to selectively use either one of the respective cams 15*a*, 16*a*, 15*b*, 16*b* for performing opening/closing operation of the intake valve 6. The valve actuating mechanism 5 having such an arrangement further includes the first rocker arm moving mechanism 21 which moves the left and right rocker arms 17, 18 from the first operation position side to the second operation position side, the second rocker arm moving mechanism 22 which moves the left and right rocker arms 17, 18 from the second operation position side to the first operation position side, and the trigger arm 33 which is supported on the cylinder head 2 for restricting the movement of the left and right rocker arms 17, 18 in the axial direction of the rocker arms 17, 18 in response to the rocking state of the left and right rocker arms 17, 18, and the left and right rocker arms 17, 18 and the trigger arm 33 respectively include the left and right rocker-side key portions 38, 39 and the left and right trigger-side key portions 34, 35 which are capable of being brought into contact with each other in the axial direction, and the respective key portions 38, 39, 34, 35 are configured to increase or decrease the contact margins thereof in the axial direction in response to the rocking state of the left and right rocker arms 17, 18 and eliminate the contact margins thereof when the intake valve 6 is closed, and the left and right rocker arms 17, 18 are moved to the corresponding operation position by either one of the respective rocker arm moving mechanisms 21, 22.

Due to such an arrangement, by mechanically changing over the restriction on the movement of the left and right rocker arms 17, 18 and the removal of the restriction in response to the rocking state of the left and right rocker arms 17, 18, that is, in response to the open/close state of the intake valve 6, it is possible to move the left and right rocker arms 17, 18. Particularly, the restriction on the movement of the left and right rocker arms 17, 18 is removed when the intake valve 6 is closed and hence, it is possible to reduce the forces which are imparted for moving the left and right rocker arms 17, 18. Further, an electric sensor for detecting the open/closed state of the intake valve 6, a control and the like become unnecessary and hence, it is possible to simplify the valve actuating mechanism per se.

Further, the above-mentioned valve actuating mechanism 5 is characterized in that one of pairs of corresponding key portions (respective key portions 38, 34) of the respective left and right rocker-side key portions 38, 39 and the respective left and right trigger-side key portions 34, 35 eliminates the contact margin in the axial direction at the time of predetermined rocking of the left and right rocker arms 17, 18, and the left and right rocker arms 17, 18 are moved by a predetermined quantity to the corresponding operation position side due to either one of the respective rocker arm moving mechanisms 21, 22 in response to the elimination and, at the same time, the respective key portions 38, 34 of one pair overlap by a predetermined quantity in the axial direction, in such a state, by continuously rocking the left and right rocker arms 17, 18, the respective key portions 34, 38 of one pair operate the trigger arm 33 so as to eliminate the contact margin of the respective key portions 35, 39 of another pair in the axial direction, whereby the left and right rocker arms 17, 18 are movable to the corresponding operation position.

Due to such an arrangement, the pair of key portions 38, 39 which is mounted on the left and right rocker arms 17, 18 and the pair of key portions 34, 35 which is mounted on the trigger arm 33 are respectively brought into contact with each other in the axial direction, and the restriction on the movement of the left and right rocker arms 17, 18 brought about by the contact of the respective key portions 34, 35, 38, 39 is removed by the respective key portions 34, 38 of the pair which overlap each other by a predetermined quantity in the axial direction and hence, no additional parts other than the left and right rocker arms 17, 18 and the trigger arm 33 are necessary as parts for removing the restriction on the movement of the left and right rocker arms 17, 18 attributed to the trigger arm 33 whereby the number of parts can be reduced.

Further, the valve actuating mechanism 5 is characterized in that the intake valve 6 and the respective cams 15*a*, 16*a*, 15*b*, 16*b* are provided in a pair for each cylinder, and the left and right rocker arms 17, 18 respectively correspond to the pair of intake valves 6. The respective cams 15*a*, 16*a*, 15*b*, 16*b* and are provided such that the left and right rocker arms 17, 18 are pivotally movable relative to each other, and the left and right rocker-side key portions 38, 39 are mounted on the left and right rocker arms 17, 18, respectively.

Due to such an arrangement, the opening/closing timings or the lift quantities of the respective intake valves 6 can be set individually and, at the same time, the restrictions on the movement of the respective left and right rocker arms 17, 18 can be removed individually in response to the rocking state of the respective rocker arms 17, 18.

Further, the valve actuating mechanism 5 is characterized in that between the corresponding key portions of the respective rocker-side key portions 38, 39 and the respective trigger-side key portions 34, 35, a predetermined gap is formed in the axial direction such that forces it away from the respective rocker arm moving mechanisms 21, 22 are not imparted.

Due to such an arrangement, at the time of performing a usual operation of the engine 1 to which the forces are not imparted from the respective rocker arm moving mechanisms 21, 22 (when the changeover of the valve driving cam is not performed), frictions generated between the respective key portions 34, 35, 38, 39 can be reduced and, at the same time, when the restriction on the movement of the left and right rocker arms 17, 18 are removed, it is possible to ensure the amount of travel at the time of overlapping the respective key portions 34, 38 of one pair with a predetermined quantity in the axial direction.

Further, the above-mentioned valve actuating mechanism 5 is also characterized in that the trigger arm 33 is rockably supported on the cylinder head 2, and between the trigger arm 33 and the cylinder head 2, the spring 33*d* which biases the trigger arm 33 toward a side at which the contact margin of the respective key portions 34, 35, 38, 39 in the axial direction is increased and, at the same time, a rocking restricting portion 33*f* which restricts a rocking angle of the trigger arm 33 for suppressing the deformation of the spring 33*d* is arranged.

Due to such an arrangement, in eliminating the contact margin of the respective key portions 34, 35, 38, 39 in the axial direction at the time of removing the restriction on the movement of the left and right rocker arms 17, 18, it is possible to reduce a load applied to the spring 33*d* by reducing an excessive rocking angle of the trigger arm 33 thus contributing to the miniaturization, the reduction of weight and the reduction of cost of the spring 33*d*.

Here, the present invention is not limited to the above-mentioned embodiment. For example, the present invention may adopt the arrangement which restricts the operation of the rocker arm by the respective rocker arm moving mechanisms 21, 22 until the respective springs 23, 24 acquire a predetermined force storing state without using the trigger arm 33 for restricting the movement of the rocker arm. Further, the present invention may adopt the arrangement, which stores the force in the respective springs 23, 24 by suitably moving only the respective spring-receiving collars 25, 26 without moving the rocker arm shaft 14 in the axial direction. Further, the respective springs 23, 24 may be formed of a tensile or torsional coil spring or a leaf spring, and may be formed of a resilient material other than metal. Still further, the present invention may adopt the arrangement which, without moving the rocker arm in two stages, moves the rocker arm between the respective operation positions at a stroke when recessed portions and projecting portions of the respective key portions are aligned or engaged with each other.

Further, the engine to which the present invention is applied is not limited to a 4-valve-type engine, and may be a 2-valve-type or a 3-valve-type engine, and may adopt a single rocker arm which cannot perform relative rocking at intake and exhaust sides of one cylinder. Further, the engine to which the present invention is applied is not limited to a DOHC engine but may be an OHC or OHV engine. Further, the engine to which the present invention is applied may be applicable to a parallel plural cylinder engine other than the 4-cylinder engines, a single-cylinder engine, or various types of reciprocating engines such as a V-type plural-cylinder engine.

The embodiments of the present invention have been described as above. The present invention is not limited to the above embodiments, but various design changes can be made without departing from the present invention as set forth in the claims.

What is claimed is:

1. An engine valve actuating mechanism, comprising:

a cylinder head having a plurality of valves mounted therein for reciprocal movement thereof;

a camshaft rotatably mounted in the cylinder head, the camshaft including a first cam and a second cam for selective alternating use in operation of one of the valves;

a rocker arm shaft having a rocker arm supported thereon, the rocker arm shaft arranged parallel to the camshaft such that the rocker arm is pivotally movable about the axis of the rocker arm shaft, and is also movable in an axial direction of the rocker arm shaft so as to be selectively movable either to a first operation position, at which the rocker arm is brought into contact with the first cam, or to a second operation position at which the rocker arm is brought into contact with the second cam;

a first rocker arm moving mechanism for moving the rocker arm from the first operation position to the second operation position;

a second rocker arm moving mechanism for moving the rocker arm from the second operation position to the first operation position, and a trigger member which is pivotally supported on the cylinder head for selectively restricting axial movement of the rocker arm in response to a rocking state of the rocker arm, wherein each of the rocker arm and the trigger member includes a rocker-side key portion and a trigger-side key portion, the rocker-side key portion and the trigger-side portion being capable of being brought into contact with each other in the axial direction;

wherein the respective key portions are configured to increase or decrease contact margins thereof in the axial direction in response to the rocking state of the rocker arm and to eliminate the contact margin thereof when the engine valve is closed; and wherein during engine operation, the rocker arm is brought into contact with a selected one of the cams in response to rotation of the camshaft to operably open or close the valve, thus allowing the valve actuating mechanism to selectively use either the first cam or the second cam for operating the valve.

2. An engine valve actuating mechanism according to claim 1, wherein the rocker-side key portion consists of a pair of first and second rocker-side key portions;

the trigger-side key portion comprises a pair of first and second trigger-side key portions corresponding to the respective rocker-side key portions;

wherein one of the pairs of corresponding key portions of the respective rocker-side key portions and the respective trigger-side key portions eliminates the contact margin in the axial direction at the time of movement of the rocker arm, the rocker arm moved by an amount corresponding to the operation position side due to either one of the respective rocker arm moving mechanisms in response to the elimination of the contact margin;

the respective key portions of one pair overlap in the axial direction, wherein by continuously rocking the rocker arm in this position, the respective key portions of one pair of valves operate the trigger portions so as to eliminate a contact margin of the respective key portions of another pair of valves in the axial direction, whereby the rocker arms are movable to the corresponding operating position.

3. An engine valve actuating mechanism according to claim 2, wherein the engine comprises a plurality of cylinders, wherein the pair of engine valves and the pair of cams are provided in a pair for each cylinder, and wherein the rocker arm mechanism comprises a pair of first and second rocker arms which correspond to the pair of engine valves and the cams, respectively, and which are pivotally movable relative to each other, and the first and second rocker-side key portions are respectively provided on the first and second rocker arms.

4. An engine valve actuating mechanism according to claim 2, wherein between the corresponding key portions of the respective rocker-side key portions and the respective trigger-side key portions, a gap is formed in the axial direction such that forces from the respective rocker arm moving mechanism are not conveyed to adjacent components.

5. An engine valve actuating mechanism according to claim 1, wherein the trigger member is rockably supported on the engine structural body, and between the trigger member and the engine structural body;

further comprising a resilient member which biases the trigger member toward a side at which the contact margin of the respective key portions in the axial direction is increased; and a rocking restricting portion which restricts a rocking angle of the trigger member for suppressing the deformation of the resilient member.

6. The engine valve actuating mechanism according to claim 1, wherein the opening/closing timings and the lift quantities of the respective engine valves can be set individually, and the restrictions on the movement of the respective rocker arms can be removed individually in response to the rocking state of the respective rocker arms.

7. The engine valve actuating mechanism according to claim 3, further comprising a center collar mounted on the rocker arm shaft, and wherein the first and second rocker arms are biased inwardly in the lateral direction of the cylinder due to first and second rocker arm moving mechanisms and are movably supported on the rocker arm shaft such that proximal portions of the first and second rocker arms abut each other in the axial direction of the rocker arm shaft by way of the center collar.

8. The engine valve actuating mechanism according to claim 7, wherein the center collar is mounted on the rocker arm shaft by way of an pin which penetrates a through hole in the collar and a slit hole in the rocker arm shaft and the collar is axially movable of the rocker arm shaft by a quantity corresponding to the length of the slit hole.

9. The engine valve actuating mechanism according to claim 1, wherein when the trigger member assumes a first rocking state, the restriction on the movement of the first and second rocker arms are maintained.

10. The engine valve actuating mechanism according to claim 1, wherein the trigger member is rockably supported on the engine structural body and between the trigger member and the engine structural body is provided a resilient member which biases the trigger member toward a side at which the contact margin of the respective key portions in the axial direction is increased and, at the same time, a rocking restriction portion restricts the rocking angle of the trigger member while also suppressing the deformation of the resilient member.

11. The engine valve actuating mechanism according to claim 1, wherein the valve actuating mechanism opens and closes the valves using a low-speed rotation cam in a low-rotary speed range in which an engine rotary speed is less than 6000 rpm the variable valve adjustment mechanism opens and closes the respective valves using a high-speed rotation cam in a high-speed rotation range in which the engine rotary speed is 6000 rpm or more.

12. A variable engine valve actuating mechanism, the engine having at least one cylinder, a camshaft including a pair of cams for actuation of each valve, and at least one intake valve and one exhaust valve for each cylinder, the variable valve actuating mechanism comprising:

a rocker arm shaft parallel with the camshaft, the rocker arm shaft movable axially by a drive mechanism;

a rocker arm supported on the rocker arm shaft and pivotally movable in response to contact with one of the cams rotating on the camshaft to open and close the valve;

the rocker arm movable between a first operating position and a second operating position, each operating position corresponding to one of the cams;

first and second rocker arm moving mechanisms for moving the rocker arm between the first and second operating positions; and movement-restricting mechanism for preventing the movement of the rocker arm;

wherein the movement-restricting mechanism comprises a trigger member and rocker-side and trigger member side key portions that contact each other.

13. The variable valve actuating mechanism of claim 12, wherein the rocker arm comprises first and second rocker arms.

14. The variable valve actuating mechanism of claim 12, wherein the rocker arm biased between the first and second operating positions by at least one spring member.

15. The variable valve actuating mechanism of claim 12, wherein the valve actuating mechanism of the engine changes valve opening/closing timings and lift quantities of the respective valves.

16. The variable valve actuating mechanism of claim 12, wherein the valve actuating mechanism opens and closes the respective valves using a low-speed rotation cam in a low-rotary speed range in which an engine rotary speed is less than 6000 rpm and the variable valve adjustment mechanism opens and closes the respective valves using a high-speed rotation cam in a high-speed rotation range in which the engine rotary speed is 6000 rpm or more.

17. The variable valve actuating mechanism of claim 12, wherein the camshaft includes a first cam for low speed and a second cam for high speed for each valve, and wherein each of the first and second rocker arm moving mechanisms is operable to select the appropriate cam depending on the engine speed.

18. A variable engine valve actuating mechanism, the engine having at least one cylinder, a camshaft including a pair of cams for actuation of each valve, and at least one intake valve and one exhaust valve for each cylinder, the variable valve actuating mechanism comprising:

a rocker arm shaft parallel with the camshaft, the rocker arm shaft movable axially by a drive mechanism;

a rocker arm supported on the rocker arm shaft and pivotally movable in response to contact with one of the cams rotating on the camshaft to open and close the valve;

the rocker arm movable between a first operating position and a second operating position, each operating position corresponding to one of the cams;

first and second rocker arm moving mechanisms for moving the rocker arm between the first and second operating positions; and movement-restricting mechanism for preventing the movement of the rocker arm;

wherein the movement-restricting mechanism comprises a pair of key portions, the key portions including rocker-side key portions and trigger-side key portions, and a gap formed in the axial direction that prevents the rocker arm moving mechanism from acting on the rocker arm.

19. The variable valve actuating mechanism of claim 18, wherein the key portions mounted on the rocker arm and key portions mounted on the trigger member are respectively brought into contact with each other in the axial direction, and the restriction on the movement of the rocker arm brought about by the contact of the respective key portions is removed by the pair of respective key portions which overlap each other in the axial direction by a predetermined overlapping.

* * * * *